US009799169B1

(12) United States Patent
Bintliff

(10) Patent No.: US 9,799,169 B1
(45) Date of Patent: Oct. 24, 2017

(54) ON-LINE LOTTERY WITH PLAYER EXCLUSION BASED ON CITIZENSHIP AND RESIDENCY

(71) Applicant: Jonathan Gibson Bintliff, Saipan, MP (US)

(72) Inventor: Jonathan Gibson Bintliff, Saipan, MP (US)

(73) Assignee: Johnathan Gibson Bintliff, Saipan, MP (US)

( * ) Notice: Subject to any disclaimer, the term of this patent is extended or adjusted under 35 U.S.C. 154(b) by 978 days.

(21) Appl. No.: 14/137,938

(22) Filed: Dec. 20, 2013

Related U.S. Application Data

(60) Provisional application No. 61/745,203, filed on Dec. 21, 2012.

(51) Int. Cl.
*G07F 17/32* (2006.01)

(52) U.S. Cl.
CPC ..... *G07F 17/329* (2013.01)

(58) Field of Classification Search
CPC .. G07F 17/32; G07F 17/3239; G07F 17/3225; G07F 17/3232; G07F 17/323; G07F 17/3237
See application file for complete search history.

(56) References Cited

U.S. PATENT DOCUMENTS 6,183,140 B1 2/2001 Singer et al.
6,853,973 B2 2/2005 Mathews et al.
7,419,426 B2 * 9/2008 Daskalakis ..... G06Q 30/0212 463/17
7,931,529 B2 4/2011 Yacenda
2003/0125973 A1 * 7/2003 Mathews ..... G06Q 20/206 705/317
2003/0224854 A1 * 12/2003 Joao ..... G07F 17/3244 463/40
2003/0236120 A1 12/2003 Reece et al.
2004/0147313 A1 7/2004 Stanley et al.
2005/0075983 A1 4/2005 St.-Denis
2007/0055440 A1 3/2007 Denker et al.
2007/0235927 A1 * 10/2007 Wright ..... A63F 3/06 273/139
2007/0250441 A1 10/2007 Paulsen et al.
2008/0194311 A1 8/2008 Cage et al.
2009/0037311 A1 2/2009 Omar
2009/0055301 A1 2/2009 Drury
2009/0177480 A1 7/2009 Chen et al.
(Continued)

OTHER PUBLICATIONS

U.S. Gambling Tax Recovery, Author: Brad Howland, First Posted: Jan. 2, 2007 (http://www.howlandtax.com/articles/gambling.htm), pp. 1-3.*

(Continued)

*Primary Examiner* — Jasson Yoo
(74) *Attorney, Agent, or Firm* — Fenwick & West LLP

(57) ABSTRACT

An on-line lottery is operated from a jurisdiction, with only players who are not citizens or residents of the jurisdiction being eligible to participate. The eligibility of a prospective player is checked at sign-up and/or when selected to win a prize. If a prospective player is determined to be a citizen or resident of the jurisdiction, their participation in the lottery is nullified, meaning the prospective player was not entered in the lottery, and thus was never eligible to win a prize.

23 Claims, 8 Drawing Sheets

(56) References Cited

U.S. PATENT DOCUMENTS

| | | | | |
|---|---|---|---|---|
| 2009/0239650 | A1* | 9/2009 | Alderucci | G06Q 20/207 463/25 |
| 2009/0275396 | A1 | 11/2009 | Felice | |
| 2010/0131312 | A1 | 5/2010 | Barnes, IV et al. | |
| 2010/0184505 | A1 | 7/2010 | Bryson et al. | |
| 2010/0250676 | A1 | 9/2010 | Ufford et al. | |
| 2011/0191247 | A1 | 8/2011 | Dominguez et al. | |
| 2011/0281630 | A1 | 11/2011 | Omar | |

OTHER PUBLICATIONS

"Online Purchasing Form/Registration for Irish Prize Bonds," 2014 AN Post, 3 pages, [Online] [Retrieved on Jun. 3, 2014] Retrieved from the Internet<URL:https://www.prizebonds.ie/online/purchasing/online.asp>.

"Prize Bonds Application Form," Republic of Ireland, 2 pages, [Online] [Retrieved on Jun. 3, 2014] Retrieved from the Internet<URL:http://www.statesavings.ie/Downloads/PrizeBondsApForm.pdf>.

Premium bonds for non-British citizens, Posted by Bjorn Rayner, Apr. 7, 2008, 3 pages, Retrieved from the Internet<URL:http://premiumbonds.blogspot.com/2008/04/premium-bonds-for-non-british-citizens.html.

Archive of "National Bonds," www.nationalbonds.ae, 1 page, [Online] [Archived by http://archive.org on Jul. 7, 2011; Retrieved on Jul. 24, 2014] Retrieved from the Internet<URL: https://web.archive.org/web/20110707025047/http://nationalbonds.ae/enhome/individuals/products/usd-dirham-linked-sukuk.aspx?id=menu_1)>.

Archive of "Everest Poker Terms and Conditions," www.everestpoker.fr, 23 pages, [Online] [Archived by http://archive.org on Jun. 16, 2012; Retrieved on Jul. 24, 2014] Retrieved from the Internet<URL:https://web.archive.org/web/20120616045932/http://www.everestpoker.fr/en/about/policies/terms>.

Archive of "Interactive Gaming Council: The IGC's Submission to the Nevada Gaming Commission,", www.igcouncil.org, 2 pages, [Online] [Archived by http://archive.org on Aug. 28, 2013; Retrieved on Jul. 24, 2014] Retrieved from the Internet<URL: https://web.archive.org/web/20130828103057/http://w3.igcouncil.org/content/view/135/99/.

"Bank Savings Incentive Programs," Community Developments Fact Sheet, Controller of the Currency Administrator of National Banks, US Department of the Treasury, Jun. 2011, pp. 1-3.

"Prize Package Winners Must Submit Identity Verification Form," Elite Battle Zone, vBulletin Solutions, Inc., 2012, 3 pages, [Online] [Retrieved on Aug. 23, 2012] Retrieved from the Internet<URL:http://www.elitebattlezone.com/showthread.php/6863-Prize-Package-Win . . . >.

"Get Rewarded for Your Savings, Not Your Spending," SaveUp, Inc., 28 pages, [Online] [Retrieved on Aug. 3, 2012] Retrieved from the Internet<URL:https://www.saveup.com/ >.

* cited by examiner

500

Citizenship

| Residency | U.S. | Non-U.S. |
|---|---|---|
| U.S. | 501 **Ineligible**<br>• U.S. Birth Records<br>• U.S. Naturalization Records<br>• U.S. Passport<br>• GPS Data within U.S.<br>• IP Location Data within U.S.<br>• Has U.S. Phone Number<br>• Address is in U.S.<br>• Has U.S. Bank account<br>• Has Active Social Security No. | 502 **Ineligible**<br>• U.S. Immigration Records<br>• GPS Data within U.S.<br>• IP Location Data Within U.S.<br>• Has U.S. Phone Number<br>• Address is in U.S.<br>• Has U.S. Bank Account<br>• Has Active Social Security No. |
| Non-U.S. | **Ineligible**<br>• U.S. Birth Records<br>• U.S. Naturalization Records<br>• U.S. Passport<br>• Foreign Immigration Records<br>503 | **Eligible**<br>• Foreign Passport<br>• Foreign Birth Certificate<br>• Address in Foreign Country<br>• Has Foreign Bank Account<br>• Has Foreign Phone Number<br>• Foreign Phonebook<br>• GPS Data outside U.S.<br>• IP Location Data outside U.S.<br>• Foreign Immigration Records<br>• U.S. Expatriation Records<br>504 |

FIG. 5

ON-LINE LOTTERY WITH PLAYER EXCLUSION BASED ON CITIZENSHIP AND RESIDENCY

BACKGROUND

1. Technical Field

The subject matter described herein generally relates to operating online lotteries, and specifically to an on-line lottery that excludes ineligible players based on geographic and legal jurisdictions.

2. Background

The operation of lotteries has a long history. In general terms, a lottery involves players purchasing tickets ("lots") and then prizes being awarded by the drawing of lots. Evidence of lotteries has been found in contemporary texts from many ancient cultures, including the Han Dynasty in China and the Roman Empire. In 1612, King James I of England granted permission for a lottery to be used to help finance the Colony of Virginia, and lotteries were a popular method of raising finances for both the Crown and the Patriots during the Revolutionary War Period. However, by the early $20^{th}$ Century, lotteries had fallen out of favor in the United States, with state and federal laws making lotteries illegal.

Over the last fifty years, lotteries have reemerged as an alternative to increased taxation for raising revenues. Around two-thirds of the states in the U.S. currently operate some form of statewide lottery, with scratch card games being particularly popular. However, for the most part, under state and federal laws it is generally illegal for private companies to operate lotteries.

One exception is the recent development and popularization of Prize Linked Savings (PLS) systems. The general concept of PLS is to reward people for good financial behavior, such as investing in a savings account or paying down debt. Typically, an individual is rewarded with one entry in a lottery for each unit of pre-determined amount (e.g., $25) put into a savings account (or used to pay down debt). While the Supreme Court has ruled that PLS systems are lotteries, a number of states have passed legislation explicitly authorizing certain financial institutions (e.g., credit unions) to operate PLS lotteries that are open to credit union members who are residents of their respective states.

A key distinction between a PLS lottery and a typical lottery is that in a PLS lottery, players can always get the money they put in back, regardless of whether they win a prize. One consequence of this is that, unlike conventional lotteries, the money put in by players is not available as prize money. Therefore, any prizes offered have to be funded in another manner. Some existing PLS lotteries fund prizes through grants and charitable donations based on the positive effect such systems can have on saving habits, particularly within communities of lesser economic means. However, the availability of such grants and donations is limited and represents a serious obstacle to providing prizes that are large enough to successfully incentivize people to improve their financial habits. The legal restrictions that limit the operation of PLS lotteries to a relatively small number of entities in specific jurisdictions also significantly restricts the viability of PLS lotteries as a wide-spread tool for encouraging good financial habits.

SUMMARY

A system and method for operating a lottery from a jurisdiction in which prospective players who are citizens or residents of the jurisdiction are excluded from participating, but players who are not citizens or residents of the jurisdiction are allowed to participate. The lottery system, comprising computer implemented modules, such as a lottery module, eligibility module, prize module, user profile module, and various databases, operates in the jurisdiction. Players in one or more other jurisdictions participate in the lottery by communicating with the lottery system via client devices, such as cell phones, laptops, PDAs, and desktop computers.

The lottery can be an online lottery or an online prize-linked savings (PLS) system. In one embodiment of an online lottery, players purchase entries into the lottery, which are held in a player's account. In the PLS lottery, players open a PLS account into which they deposit funds for saving, and for which they may receive some amount of interest. Players also earn points for exhibiting desirable financial behaviors, such as making deposits, taking financial literacy courses, recruiting other players, and/or interacting with third party partners in a desirable manner, such as viewing advertisements. These points can then be exchanged for entries in the lottery, and hence a chance to win a prize.

When a person attempts to open an account, the eligibility module determines whether the person is either a resident or citizen of the jurisdiction where the lottery system is being operated. If so, the person is an "Excluded Person," and is not eligible to participate in the lottery. That is, a person is eligible to participate in the lottery only if he or she is not an Excluded Person. In one embodiment, a person who is either a U.S. citizen or U.S. resident is an Excluded Person, and therefore not eligible to participate. For example, a person who is a U.S. citizen residing in Britain would be excluded; a person who is a Japanese citizen, but living in Hawaii would likewise be excluded. Persons who are both citizens and residents of other countries are eligible to participate. Assuming a person is not excluded, they are allowed to open an account and become an eligible player in the online lottery or PLS.

As part of the account creation process a prospective player is presented on their client device with a terms of service (TOS) agreement, to which they must agree in order to be allowed to participate. In one embodiment, the TOS contains a term stating that the player represents and acknowledges that they are not a resident of the jurisdiction (e.g., the U.S.) and not a citizen of the jurisdiction. Residency or citizenship in the jurisdiction is the basis for excluding persons from participation, and thus the player is required to make a representation that they are eligible to participate. Second, the TOS contains a term stating that the player acknowledges and agrees that should they subsequently be determined to be resident or citizen of the jurisdiction, then their entry or entries in the online lottery or PLS will be deemed to be null and void. As such, they will have never entered the lottery or PLS at all, and thus were not and/or are not presently eligible to win any prizes. This latter acknowledgement is referred to as Retroactive Exclusion.

Subsequently, in a given lottery a player is associated with a winning entry. The eligibility module again determines that the player associated with the winning entry is eligible to win, including verifying that the player is not a citizen or resident of the jurisdiction. This subsequent second eligibility check ensures that players who are initially eligible to participate do not become ineligible. For example, in above mentioned embodiment, a player who is citizen and resident of Canada would be initially eligible to participate to open an account; if that player moved to the U.S. (while retaining their Canadian citizenship), and then subsequently is associated with a winning entry, the eligibility module would determine that the player is now ineligible due to their U.S. residence. In addition, the second eligibility check may identify players who provided false information to pass the first eligibility check. If the second eligibility check determines that the player is ineligible, then they were not in fact entered in the lottery in the first place, and thus are not awarded the lottery prize. Under the Retroactive Exclusion term of the TOS, they have agreed to this result.

In one embodiment, a method of operating a lottery implemented on a lottery computer system comprises receiving a request from a prospective player to create a user profile that includes user profile data. The user profile data is used to determine if the prospective player is a citizen or resident of the jurisdiction, and if the prospective player is determined to not be a citizen or resident of the jurisdiction, the user profile is created, thus making the prospective player a registered player. A plurality of entries into the lottery is received, with each entry corresponding to one or more registered players. A winning entry is selected and the corresponding player is awarded a prize.

In another embodiment, a method of operating a lottery implemented on a lottery computer system comprises receiving a plurality of entries into the lottery, with each entry being associated with a corresponding user. One of the entries is selected as a winning entry, the winning entry being associated with a first user. The user profile data of the first user is analyzed to determine whether the first user is a citizen or resident of the jurisdiction. If the first user is determined to not be a citizen or resident of the jurisdiction, the first user is awarded a prize.

In a further embodiment, a method of operating a lottery implemented on a lottery computer system comprises receiving requests to participate in the lottery from a plurality of prospective players, with each request including a user profile comprising identity information, residential information, and citizenship information of the prospective player. Those prospective players that are not citizens or residents of the jurisdiction are identified from the user profiles, with only those prospective players identified as not residents or citizens of the jurisdiction being registered as eligible to participate in the lottery. A plurality of entries into the lottery is received, with each entry corresponding to at least one of the registered players, and a winning entry is selected. The user profile of the registered player corresponding to the winning entry is updated and the updated user profile used to confirm that the registered player is not a citizen or resident of the jurisdiction. If the player corresponding to the winning entry is determined to not be a citizen or resident of the jurisdiction, a prize is awarded.

One embodiment of a computer system for operating a lottery includes a data store, an eligibility module, a pay-in module, a lottery module, and a pay-out module. The data store stores user profiles of players; the eligibility module analyzes user profile data to determine whether a user is a citizen or resident of the jurisdiction, and enables a user to register as a player in the lottery or collect a prize from the lottery only if a user is not a resident or citizen of the jurisdiction; the pay-in module identifies a number of entries into the lottery for each player based on financial behavior of the player; the lottery module selects a winning entry; and the pay-out module awards a prize to the player corresponding to the winning entry only if the eligibility module determines that the player corresponding to the winning entry is not a resident or citizen of the jurisdiction.

The features and advantages described in this summary and the following detailed description are not all-inclusive. Many additional features and advantages will be apparent to one of ordinary skill in the art in view of the drawings and specification, hereof.

BRIEF DESCRIPTION OF THE DRAWINGS

FIG. 5 illustrates exemplary data that may be used to determine whether a prospective player is a U.S. resident and/or citizen and therefore excluded from participating in a lottery.

The Figures (FIGS.) and the following description describe certain embodiments by way of illustration only. One skilled in the art will readily recognize from the following description that alternative embodiments of the structures and methods illustrated herein may be employed without departing from the principles described herein. Reference will now be made to several embodiments, examples of which are illustrated in the accompanying figures. It is noted that wherever practicable similar or like reference numbers may be used in the figures and may indicate similar or like functionality.

DETAILED DESCRIPTION

System Overview

Throughout this disclosure, for the purpose of clarity, an embodiment is described in which an online lottery is operated by a lottery system physically located within the United States, with United States citizens or residents being excluded from participating in the lottery. For the purposes of this disclosure the terms "U.S." and "United States" includes all fifty states, the District of Columbia, U.S. territories, and American Indian reservations, and thus a person who is either a resident of the U.S. or a citizen of the U.S. is identified as an "Excluded Person." Also, the terms "user" and "player" will be used interchangeably herein.

Figure 1:
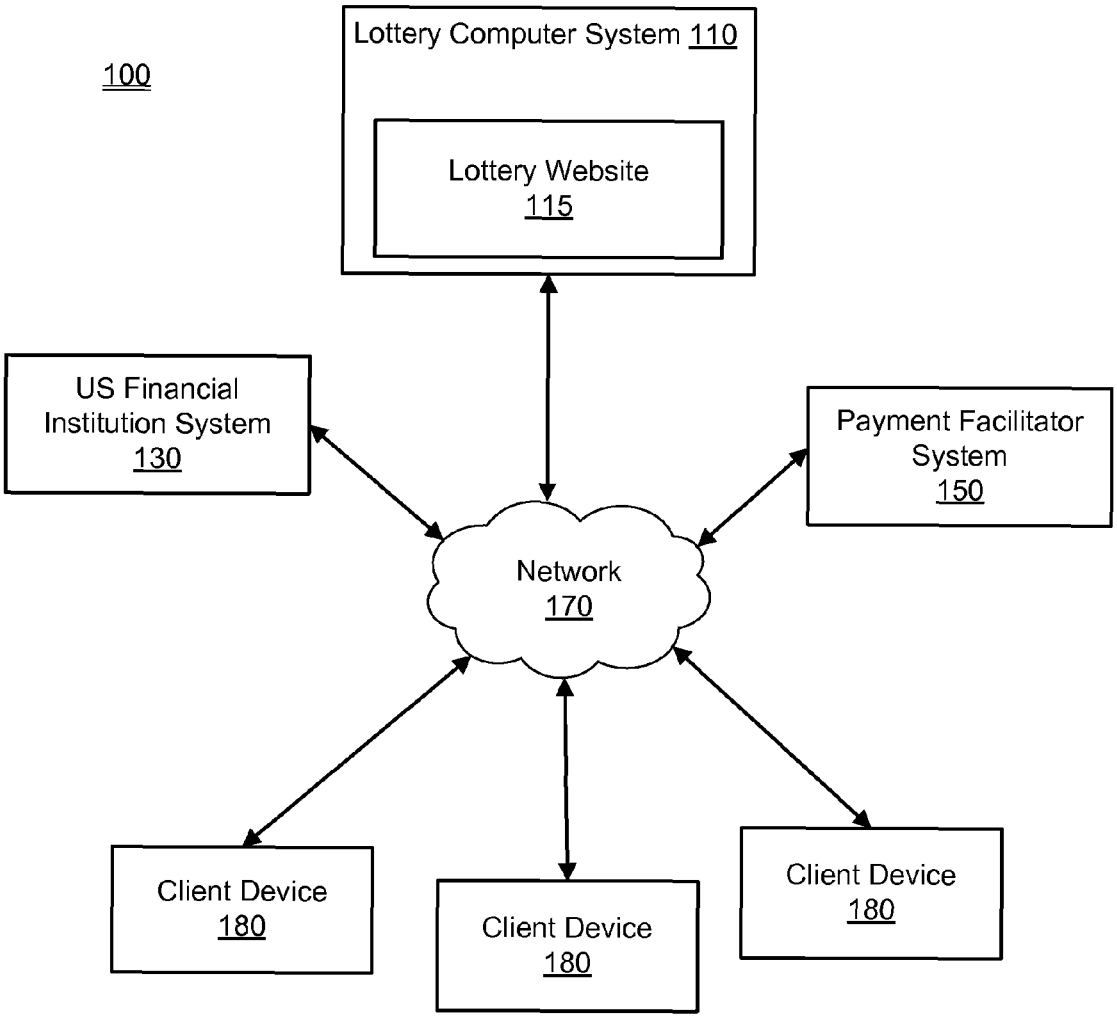
FIG. 1 is a high-level block diagram illustrating a networked computing environment suitable for operating an online lottery with U.S. player exclusion.

FIG. 1 illustrates a networked computing environment for operating an online lottery which is configured to exclude players who are either U.S. citizens or U.S. residents. The networked computing environment includes a lottery computer system 110, a U.S. financial institution system 130, a payment facilitator system 150, and a plurality of client devices 180 (of which three are shown for exemplary purposes only), all communicatively connected via a network 170. Other embodiments of the networked computing environment include different and/or additional components. While only one lottery computer system 110, U.S. financial institution system 130, and payment facilitator system 150 are shown for clarity, other embodiments can have multiple such entities. In addition, the functionality may be distributed among the components in a different manner than described herein. For example, if the online lottery is run by a U.S. financial institution, the functions of the U.S. financial institution system 130 and the lottery computer system 110 may be performed by a single entity.

The network 170 represents the communication pathway between the various entities in the networked computing environment 100. The network 170 is typically the Internet, but can be any network, including, but not limited to, any combination of a LAN, a MAN, a WAN, a mobile, a wired or wireless network, a private network, or a virtual private network, configured to operate using communication protocols for physical, data-link, network, transport, session, presentation, and application layers. The particular selection and implementation of the network protocols is not a material element of the present invention.

The lottery computer system 110 operates the online lottery and provides associated functionality to the client devices 180 of players, via the network 170. The lottery computer system 110 is maintained by a system operator, which can be a financial institution (e.g., a bank or credit union), a government agency, a private lottery company, or any other commercial entity. Hereinafter, the term "online lottery" will be used to include both PLS-type lotteries and non-PLS lotteries.

The U.S. financial institution system 130 comprises one or more computers that provide electronic financial services to the system operator, and is operated by a U.S. financial institution (i.e., an institution authorized to provide financial services within the United States). The U.S. financial institution is typically a bank; however, other institutions, such as credit unions or the system operator itself may provide the financial services. In one embodiment, the operator of the lottery system 110 maintains one or more account with the U.S. financial institution and deposits all income (e.g., lottery ticket sales, advertisement revenue, investment, etc.) into these accounts. The funds in the accounts are then used to cover operating expenses, make interest bearing investments, and pay-out prizes to lottery winners. In other embodiments, the operator of the lottery system 110 maintains multiple accounts with multiple U.S. financial institutions. In this way, income from different sources and/or intended for different expenses can be maintained separately to aid accounting, improve efficiency, maximize investment returns, and provide greater financial transparency to regulators, potential investors, and the like.

In one embodiment of a PLS system, each player maintains an account on the lottery computer system 110, into which the player deposits funds, may earn interest, and can receive any lottery winnings. The system operator pools the deposited amounts, and invests those amounts in interest bearing accounts in a U.S. financial institution, where the accounts are preferably backed by the FDIC, so as to protect the underlying principle deposits of the players. One form of interest bearing mechanism that can be used for this purpose is the Certificate of Deposit Account Registry Service (CDARS). CDARS allows the multiple accounts of the players to be aggregated into deposit amounts exceeding the $250,000 limit imposed by the FDIC on individual accounts. In this manner, players who are residents and citizens of foreign jurisdiction benefit from the protection of their deposits under both U.S. banking laws, and federal deposit insurance, something that would otherwise be unavailable to them as private individual investors in other countries.

The payment facilitator system 150 comprises one or more computers that provide electronic financial services to a player of the lottery. The payment facilitator system 150 may be provided by a foreign bank, foreign financial institution, third party payment system (e.g., Paypal, Boku, Zong, Bango), wireless provider (e.g., Smart Communications, Sun Cellular), online payment gateway (Offgames, I-Pay, Eco Card, Vinapay), prepaid card provider (e.g., CiB Mall, Cherry Credits, MyCard), bank transfer network (e.g., eNETS, DragonPay, MoneyGram, Xoom, Western Union), or ecommerce operator (e.g., Alibaba, Amazon, DangDang). For example, a player may have a mobile telephone with a prepaid communications account provided by SMART, a wireless communications provider, which enables its payment transactions for its subscribers. A player would then purchase entries to the lottery using their SMART account, with such purchases being deducted from their prepaid accounts. If the player has a monthly account with SMART, then purchases will be billed on their monthly billing statements. As another example, players maintain accounts at a local financial institution in their jurisdiction into which account lottery winnings can be deposited, as well as withdrawals from a player's PLS account should a player wish to remove some or all of their principle investment from the lottery. The player may be required to have a bank account before participating in the online lottery. Alternatively, the player may only be required to open the bank account if they have lottery winnings to deposit, in which case, the online lottery operator may assist the player in opening the bank account by providing a programmatic interface from the lottery computer system 110 to a website of the payment facilitator system 150. Such assistance may be particularly valuable when the player resides in a country or region with high levels of poverty where many residents do not have a bank account and do not generally save money in such accounts. Where the online lottery is a PLS type lottery, players are required to have an account with a payment facilitator system 150 into which winnings and other funds can be deposited. A player's entries in the online PLS lottery are determined by their financial interactions with their payment facilitator system 150 and other behavior with regards to the PLS system. The operation of PLS systems and regular lotteries are described in greater detail below, with reference to FIGS. 4-8.

The client devices 180 can be any devices capable of communicating with the lottery computer system 110 to enable a player to participate in an online lottery, such as cell phones, smartphones, desktop PCs, laptops, PDAs, electronic book readers, and the like. As discussed above, although only three client devices 180 are shown, in practice there are many (e.g., millions of) client devices 180 that can connect to the network 170. An exemplary client device is described in greater detail below, with reference to FIG. 3.

Computing System Architecture

Figure 2:
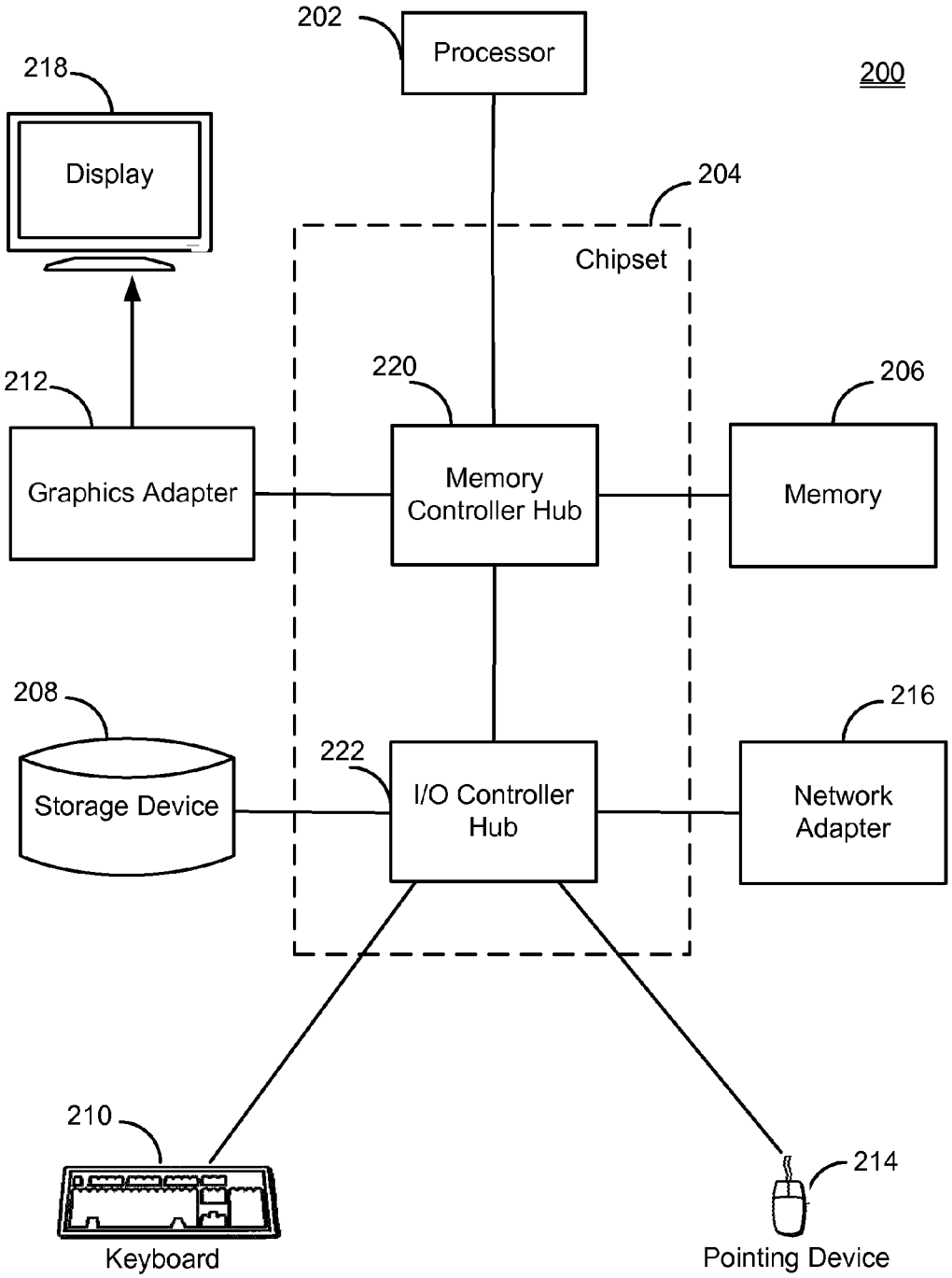
FIG. 2 is a high-level block diagram illustrating an example of a computer for use as a lottery computer system, a financial institution system, or a client device.

The entities shown in FIG. 1 are implemented using one or more computers. FIG. 2 is a high-level block diagram illustrating an example computer 200. The computer 200 includes at least one processor 202 coupled to a chipset 204. The chipset 204 includes a memory controller hub 220 and an input/output (I/O) controller hub 222. A memory 206 and a graphics adapter 212 are coupled to the memory controller hub 220, and a display 218 is coupled to the graphics adapter 212. A storage device 208, keyboard 210, pointing device 214, and network adapter 216 are coupled to the I/O controller hub 222. Other embodiments of the computer 200 have different architectures.

The storage device 208 is a non-transitory computer-readable storage medium such as a hard drive, compact disk read-only memory (CD-ROM), DVD, or a solid-state memory device. The memory 206 holds instructions and data used by the processor 202. The pointing device 214 is a mouse, track ball, or other type of pointing device, and is used in combination with the keyboard 210 to input data into the computer system 200. The graphics adapter 212 displays images and other information on the display 218. The network adapter 216 couples the computer system 200 to one or more computer networks.

The computer 200 is adapted to execute computer program modules for providing functionality described herein. As used herein, the term "module" refers to computer program logic used to provide the specified functionality. Thus, a module can be implemented in hardware, firmware, and/or software. In one embodiment, program modules are stored on the storage device 208, loaded into the memory 206, and executed by the processor 202.

The types of computers used by the entities of FIG. 1 can vary depending upon the embodiment and the processing power required by the entity. For example, the lottery computer system 110 might comprise multiple server class computers working together to provide the functionality described herein, whereas the client devices 180 might be personal computing devices. The computers can lack some of the components described above, such as keyboards 210, graphics adapters 212, and displays 218, as appropriate for their implementation.

System Details

Figure 3:
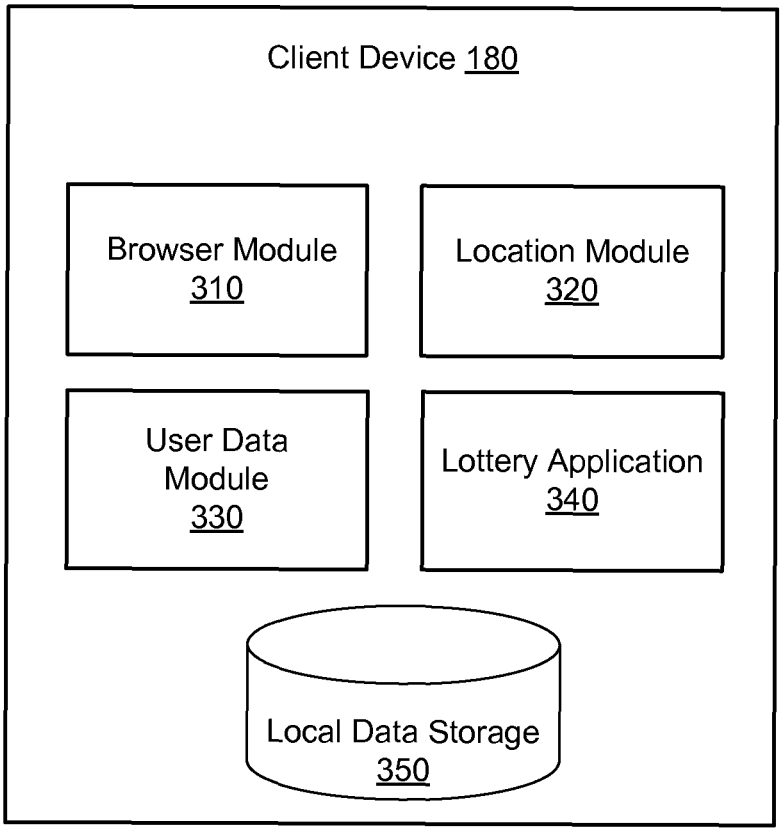
FIG. 3 is a high-level block diagram illustrating a client device suitable for use in the networked computing environment of FIG. 1.

FIG. 3 is a high-level block diagram illustrating a client device 180 suitable for enabling a player to participate in an online lottery that is run by a lottery computer system 110. In the embodiment shown, the client device 180 includes a browser module 310, a location module 320, a user data module 330, a lottery application 340, and local data storage 350. Other embodiments of the client device 180 include different and/or additional components not shown here, such as an operating system (e.g., GOOGLE ANDROID™, APPLE OS X™ or iOS™). In addition, the functionality may be distributed among the components in a different manner than described herein. For example, rather than including a lottery application 340 at the client device 180, the lottery functionality may be provided by a lottery website 115 hosted at the lottery computer system 110 and accessed at the client device using the browser module 310.

The browser module 310 is configured to enable the user of the client device 180 to access web-based content and services, such as the lottery website 115, on-line banking resources provided by the payment facilitator system 150, via the network 170, and is one means for performing this function. Numerous browsers are publicly available for use with client devices 180, such as GOOGLE CHROME™. The browser module 310 may be a stand-alone software application or it may be embedded within another application/module, such as the lottery application 340.

The location module 320 is configured to determine the current location of the user, and is one means for performing this function. The location module 320 can be implemented using a GPS based module, as typically included in many smartphones, tablet computers, and similar devices. The location module 320 may also use a cellular phone signal triangulation method to determine location based on the cell towers that can currently connect with the cell phone. The location module 320 may also use information regarding nearby IEEE 802.11 or IEEE 802.16 wireless access points the client device 180 can connect to in order to determine location. One of skill in the art will recognize and/or be aware of numerous techniques with which the location module 320 may determine the location of the client device 180.

The user data module 330 manages data relating to a user of the client device 180. As a result of day to day operation of a client device 180, the local data storage 350 can include data that can be accessed by the lottery application 340 and provided to the lottery computer system 110 to verify that the user is eligible to participate in a lottery, i.e., that the user is not an Excluded Person. For example, if the client device 180 is a user's smartphone, the user data module 330 can obtain the smartphone's phone number from local data storage. The country and area codes included in the phone number can be used as evidence that the user is a resident of the geographic region that corresponds to these codes. Other pieces of user data that may be available to the user data module 330 (either from the local data storage 350 or remotely from the network 170) include: the user's name, the user's address (as indicative of residence inside or outside of the U.S.), bank accounts associated with the user (also indicative of residence), the user's email address, and the like.

Unlike cell phones, which typically correspond to a single user, some client devices 180 (e.g., a desktop PC) correspond to multiple users, who typically have different accounts thereon. In one embodiment, when a user uses the client device 180 and logs into his or her account, the user data module 330 can determine which user is currently using the computer. The user data module 330 can then obtain permissions to access the appropriate user data corresponding to the current user.

The lottery application 340 interacts with the lottery computer system 110, via the network 170, to enable the user of the client device 180 to participate in the online lottery. In one set of embodiments, the lottery application 340 is a software application (e.g., an "app") executing on the client device 180 that communicates with the lottery computer system 110, via the network 170. Thus, a user from anywhere in the world can communicate instructions regarding participation in the lottery directly to the lottery computer system 110, located in the United States. The client device 180 and the lottery computer system 110 can also communicate with the payment facilitator system 150 to facilitate payment to the system operator for lottery entries, transfer of prize money to the user, and/or provide the lottery computer system with information regarding the user's financial behavior for the purposes of determining entries in a PLS system.

In some embodiments, the lottery application 340 is configured to periodically read information from the location module 320 (and/or the local data storage 350) regarding the user's location and maintain a historical record of the user's locations over time. The lottery application 340 may also provide user interface controls to allow the user to opt-out at a later time and/or prompt the user to provide permission for the location data to be collected on a regular basis (e.g., monthly). The collected location information can be provided to the lottery computer system 110 for use in determining whether the user is a resident of the U.S. Thus, if the user's historical locations are predominantly or entirely in the U.S., the lottery computer system 110 would determine that the user is not eligible to participate. Similarly, the location module 320 may read from the local data storage the user's contact information, including the user's home address (if listed), and provide that information to the lottery computer system 110.

As mentioned above, in one embodiment, a user uses the lottery application 340 to access the lottery computer system 110 and create an account, which may be for participation in the online lottery or in a PLS type lottery. The lottery application 340 provides a user interface for, and is configured to receive therein user profile information including the user's name, username, address, password, date of birth, citizenship, phone number, and payment information (e.g., a credit card number, or bank account number).

In the online lottery embodiment, the lottery application 340 provides a user interface for, and is configured to receive therein, a user's request for one or more entries in the online lottery. If the user has provided details of a bank account, the price of the entries is debited from the user's bank account, using third party clearinghouse services (e.g., SWIFT).

In the PLS lottery embodiment, the lottery application 340 provides a user interface for, and is configured to receive therein, a user's request to open a PLS account, make deposits into the account, and conduct other account related activities.

Figure 4:
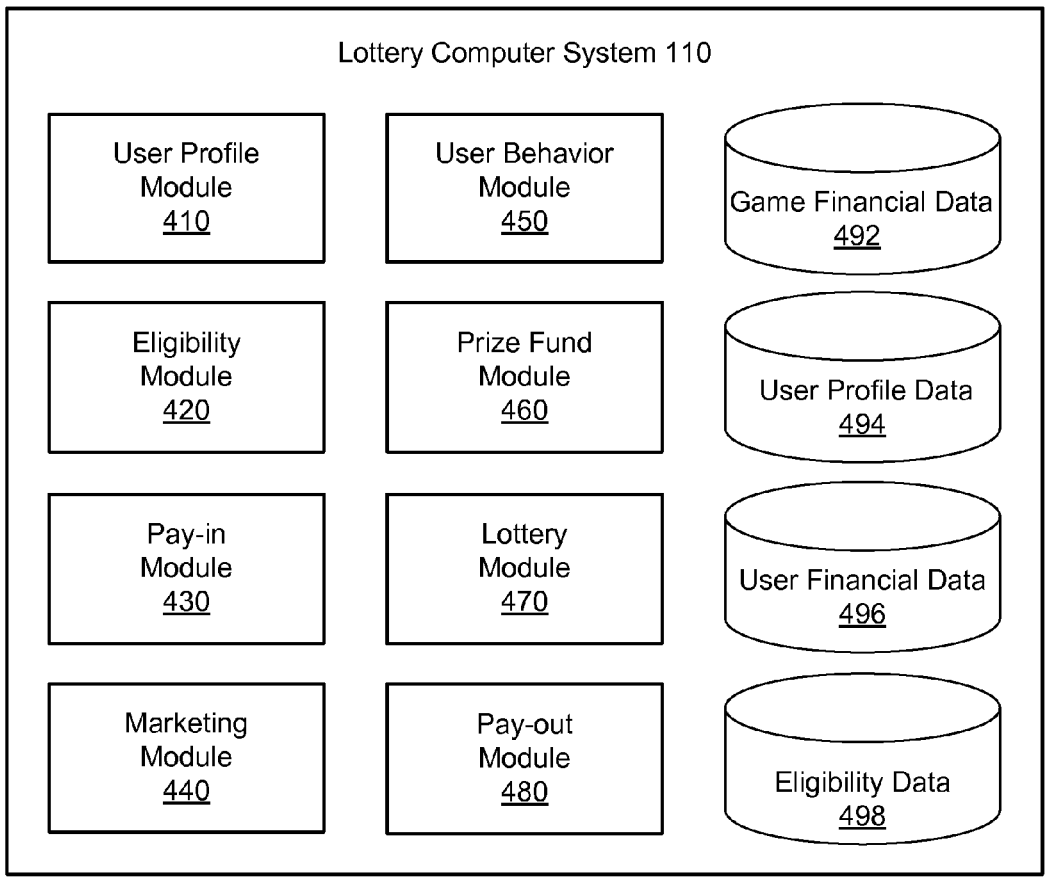
FIG. 4 is a high-level block diagram of a lottery computer system for operating a lottery with U.S. player exclusion.

FIG. 4 is a high-level block diagram illustrating a lottery computer system 110 for operating a lottery with U.S. player exclusion. In the embodiment shown, the lottery computer system 110 includes a user profile module 410, an eligibility module 420, a pay-in module 430, a marketing module 440, a user behavior module 450, a prize fund module 460, a lottery module 470, and a payout module 480. The lottery computer system 110 shown also includes storage for financial data 492, user profile data 494, user financial data 496, and eligibility data 498. Other embodiments of the lottery computer system 110 include different and/or additional components. In addition, the functionality may be distributed among the components in a different manner than described herein. As will be apparent from the following description, the operations and functions of the lottery computer system 110 are necessarily performed by computer devices operating under program control, and cannot be performed as mental steps entirely in the human mind.

In some embodiments, the functionality attributed herein to the lottery computer system 110 is distributed between multiple different systems, potentially operated by different entities, operating together to provide an online lottery. For example, a gaming company may operate a portion of the lottery including the lottery mechanics of managing entries via an embodiment of the eligibility module 420, and selecting winning entries via an embodiment of the lottery module 470, while a financial institution may manage player accounts via an embodiment of a user profile module 410 and user profile data 494, and the prize fund (via an embodiment of the financial data 492), and allocation of winnings via an embodiment of a prize fund module 460.

The user profile module 410 creates and manages user profiles for players based on user profile data received from the browser 310 or the lottery application 320 on the client devices 180, via the network 170. The user provides details of one or more financial accounts, including checking accounts, savings accounts, credit card accounts, pension funds, and the like.

As described above, prospective players participate in the lottery using a lottery application 340 on a client device 180, which interacts with the lottery computer system 110, via the network 170. Alternatively and/or additionally, the lottery application may be embedded in a third-party website, such as a social network. Thus, players can also directly access the lottery computer system 110 via their browser application. The lottery computer system 110 and/or the lottery application 340 is configured to provide an electronic form for display at the client device 180 that requests sign up information corresponding to the prospective player, along with a presentation of a terms of service (TOS), and is one means for performing this function. The TOS form includes a user interface element for receiving an indication of the user's acceptance of the TOS. Acceptance of the TOS is required before the account creation is completed (assuming the prospective player is determined to be eligible). The TOS is further described below. The lottery application 340 sends the sign up information provided by the prospective player to the user profile module 410, via the network 170. In one embodiment, the electronic form requests a name, address, citizenship information, and if necessary, details of an account with a payment facilitator. The user profile module 410 then stores this information along with information about the client device 180 used to complete the electronic form (e.g., IP address, registered owner, etc.) in the user profile data 494. Other embodiments collect different and/or additional information.

In some embodiments, a user profile also includes a list of other users that registered with the lottery computer system 110 in response to an invitation sent by the user, referred to collectively herein as the user's "tribe." In one such embodiment, a user can invite a friend to register for the online lottery using an established communications link. The user provides the invited friend with an identification code (e.g., the user's player ID) when issuing the invitation. If the friend provides the identification code when registering, the friend is automatically added to the original user's tribe. The user profile module 410 may also record an indication of the user that invited the friend in the friend's user profile.

In another such embodiment, the lottery module 340 of a user's client device 180 provides an interface with which the user can invite friends to join the user's tribe. The user provides contact details for one or more friends (e.g., an email address, a social network profile, or a phone number) and an invitation to register for the lottery is automatically sent to the user's friend through the corresponding communication channel. The lottery module 340 may leverage the application programming interface (API) of a social network in order to provide an easy mechanism for the user to invite friends from the social network to register for the lottery. Any friends that accept the invitation and register for the lottery are automatically added to the user's tribe.

The eligibility module 420 determines whether a player is eligible to participate in the online lottery, and is one means for performing this function. As described previously, it is currently illegal for U.S. citizens and residents to participate in private (i.e., non-government run) lotteries. One way to make it legal to operate a lottery from within the United States is to have a system in place that prevents U.S. citizens and residents (Excluded Persons) from participating in the lottery. The lottery computer system 110 described herein is such a system.

As noted above, the lottery computer system 110, via the lottery application 340 or the lottery website 115, presents the user with a TOS on the client device 180 that includes terms by which the player agrees to be legally bound when participating in an online lottery or PLS type lottery. In one embodiment, the TOS includes two specific terms that the player must acknowledge in order to be allowed to participate. First, the TOS contains a term stating that the player represents and acknowledges that they are not an Excluded Person, i.e., that they are not a resident of the U.S. and not a citizen of the U.S. As described above, residency or citizenship in the U.S. is the basis for excluding players from participation, and thus the player is required to make a representation that they are eligible to participate. Second, the TOS contains a term stating that the player acknowledges and agrees that should they subsequently be determined to be an Excluded Person, then their entry or entries in the online lottery or PLS will be deemed to be null and void, such they will have never entered the lottery or PLS at all, and thus to have not won any prize, regardless of the outcome of any drawing. This latter acknowledgement is called Retroactive Exclusion. An exemplary TOS is included in Example A, below. If the user refuses to accept the TOS, then the lottery application 340 or lottery website 115 terminates the user's session, and does not create an account for the user.

In addition to requiring user agreement to the TOS, the lottery computer system 110 is configured to enforce the TOS by the analyzing the available data to identify entries and/or user profiles to determine whether a user is an Excluded Person. This is beneficial because there may be users who provide false information in the user profile, for example, providing a false address outside of the U.S., to hide their U.S. residency, or who provide false information about their citizenship.

In some embodiments, the eligibility module 420 is configured to determine player eligibility at two different points in the overall process. Firstly, the eligibility module 420 is executed during the account and profile creation process to determine eligibility of a prospective player. The eligibility module 420 analyzes the data received regarding a prospective player during profile creation to determine whether the prospective player is an Excluded Person. Secondly, the eligibility module is executed in response to the player being associated with a winning entry in a lottery, to determine whether the player is an Excluded Person at that time. The second eligibility check accounts both for players who have become Excluded Persons after account creation (e.g., by immigrating to the United States) as well as Excluded Persons who successfully created an account without being detected, e.g., those who falsified information during the sign up process.

In one such embodiment, the first eligibility check performed by the eligibility module 420 is entirely automated. First, the eligibility module 420 checks the residency information (e.g., home address) and the citizenship information provided by the player during account creation. If the player provided either a U.S. address of residence or indicated U.S. citizenship, they are excluded, and the lottery computer system 110 provides a notification to the user's client device indicating that they are not eligible to participate for that reason.

The eligibility module 420 also compares the provided user profile information to eligibility data 498 (stored either locally at the lottery computer system 110, or provided remotely by a third party) to determine if the prospective player can be positively identified as a U.S. citizen or resident, even if they have provided non-U.S. address or citizenship information. This portion of the eligibility check may also include analyzing location data for the prospective player, such as location data from the prospective player's user device 180, IP address location, and mobile telephone number, if any, to determine if the prospective player is located within the United States. As mentioned above, the location data is received from the lottery application 320. For example, if a significant threshold proportion (e.g., more than 75%) of location data within a given time period (e.g., the past 3 or 6 months prior to requesting signup) indicates locations of the user inside of the U.S., that would indicate that the user is likely to be a U.S. resident.

The eligibility module 420 may also check whether the IP address of the user's client device 180 is mapped to a server or ISP in the U.S. If so, this also indicates that the user is a U.S. resident. To perform this step, the eligibility module 420 can query a commercial IP address location service with the IP address of the client device 180.

The eligibility module 420 may also check whether the user's mobile telephone number is associated with a U.S. location (e.g., the user's mobile telephone includes an area code for a U.S. locale). If so, this further indicates that the user is a U.S. resident. To perform this step, the eligibility module 420 can query a commercial area code lookup service with the mobile telephone number.

The eligibility module 420 may also check whether the user is a U.S. citizen by querying a database of personal information with the user's name and date of birth to determine the user's place of birth. Many online commercial database services exist that compile publicly available information such as names, addresses, date of birth, and place of birth, and make available application programming interfaces for programmatic access to such records. For example LEXIS Public Records search, using the Public Record Link Builder API; RealSearch Liberty Criminal API, or WhitePages PRO API. The eligibility module 420 can be configured to query such a service, and obtain one or more matching results. If a result matching the user's name and birth date is returned, and the place of birth indicated in the result is within the U.S. then the user is identified as a U.S. citizen.

The eligibility module 420 can use one or more of the above factors to determine that the user is an Excluded Person. In this way, the first eligibility check can filter out a large number of prospective players as being Excluded Persons quickly and efficiently, even if such persons attempt to give false information in order to participate in the online lottery or PLS-type lottery.

In order to ensure that an Excluded Person is not eligible for and will not receive any lottery winnings, the second eligibility check is executed by the eligibility module 420 each time a player is associated with a winning entry in a lottery. In one embodiment, one or more of the steps of the first eligibility check are performed again, using updated information for the user's mobile telephone number and the IP address of the user's client device 180.

In other embodiments, additional eligibility steps are used by the eligibility module 420. These additional steps require the player associated with a winning entry to provide evidence that they are not an Excluded Person. Forms of data and evidence that can be used to identify Non-Excluded Persons and prove a player associated with a winning entry is eligible to receive the prize are described in greater detail below, with reference to FIG. 5. In further embodiments, eligibility checks are performed at different times and/or different data and levels of automation are used for performing eligibility checks.

The pay-in module 430 processes requests from players to put money into their accounts, either to purchase entries in an online lottery, or in the PLS type embodiment, to deposit funds for saving, and is one means for performing this function. On receiving a request to purchase entries in an online lottery, the pay-in module 430 initiates payment for the cost of the lottery entries, using a payment facilitator system 150. The pay-in module 430 also increases the number of entries in the next lottery recorded in the player's user profile accordingly.

In the PLS embodiment, multiple different lotteries may be available to users. In one such embodiment, there is a single lottery in which all players have one or more entries, dependent on the number of points they have been rewarded. In another embodiment, there are different lotteries for different groups of users, dependent on the amount of the user's initial deposit. Thus, there can be lottery for users with accounts with an initial deposit less than $100, another lottery for users with accounts with an initial deposit between $100 and $1000, and another lottery for users with accounts with an initial deposit over $1000, and so on. Similarly, there may be different lotteries for users with different total account balances, e.g., at the $100, $1000, $5000, and $10,000 levels. Having separate lotteries for different deposit or balance amounts enables scaling of the amount of prize money for a lottery to the return on investment that the deposited funds yields to the system operator, so that lotteries for higher deposit/balance accounts have higher prize amounts.

Where the lottery is part of a PLS operated by the system operator in the United States, the player deposits funds into their account to earn points, which can be exchanged for entries in the online lottery. The player provides an input to the lottery application 340 indicating the amount of money to deposit. In one embodiment, the amount of money a user deposits is directly proportional to the number of entries he receives in a given lottery. The pay-in module 430 then increases the number of points recorded in the player's user profile accordingly. The player can withdraw deposited funds at any time, as described in detail below, with reference to the pay-out module 480.

In a further such embodiment, the lottery is part of a PLS operated in conjunction with one or more foreign financial institutions. Rather than purchasing lottery entries, the player deposits funds into a savings account with one of the foreign financial institutions that is local to the player (the player's local financial institution). The deposit of funds can be performed directly with the player's local financial institution (e.g., by using an on-line banking service provided by the payment facilitator system 150) or via an on-line banking interface provided by lottery application 340, or through other deposit mechanisms, such as ATMs and in-bank deposits. Assuming the savings account is linked to the player's user profile, the pay-in module 430 receives notification that the player has deposited funds and increases the number of points recorded in the player's user profile accordingly. The player can withdraw deposited funds at any time, as described in detail below, with reference to the pay-out module 480.

The marketing module 440 provides advertisements and other promotional messages for display to players at their client devices 180, and is one means for performing this function. In one embodiment, the marketing module is configured to send an SMS text message/multimedia message advertising a local store to a player's cell phone (using the mobile telephone number provided by the player), or present a clickable advertisement for an on-line store within the lottery application 340 of the player's smartphone. The marketing module 440 may use an external advertisement serving network to obtain advertisements for presentation to the user, by passing to the advertisement serving network information identifying a current context, demographic, and interest information of the user, and receiving a selected advertisement in response.

The user behavior module 450 is configured to monitor the player's financial behavior with respect a PLS account, and provide points to the user, which are used to obtain entries into the PLS lottery associated with the user account, and is one means for performing this function. More particularly, the user behavior module 450 receives inputs indicating financial behaviors such as depositing money into the PLS account, and based on the behavior, rewards the user with some number of points, which can be exchanged for entries in the lottery. Other aspects of user behavior can also be monitored and points awarded to the user for certain actions and behaviors. For example, interaction with advertisements provided by the lottery application 340, participation in on-line courses provided by the lottery application, and whether the user invites other users to take part in the PLS (as well as the behavior of any such other users that accept the invitation) can all be monitored by the user behavior module 450 and result in points being awarded, and thus contribute to the likelihood of the user winning a prize. Various ways in which users can earn points and increase their chances of winning a prize in a PLS are described in greater detail below, with reference to FIG. 8.

In one embodiment that implements a conventional (as opposed to PLS) lottery, the user behavior module 450 rewards players with additional lottery points or entries for: 1) providing additional profile information, 2) purchasing entries in bulk, 3) engagement with third party partners via advertisements or other media, and 4) tribe activities. Providing additional profile information adds value into the lottery system, allowing for larger prizes to be awarded. The more detailed a player's profile is, the better advertisements can be targeted for the player, and thus, the greater the value of the player's profile to advertisers. Consequently, the greater the amount of profile information players provide, the greater the amount the system operator can charge to display advertisements to players, thus generating more revenue, and the larger the lottery prize fund will be. It is therefore of value to incentivize players to provide additional profile information by offering additional lottery entries. For example, a player might receive one entry (up to a maximum of ten) per interest added to the player's profile and five entries for providing a value for the player's total income, etc.

Rewarding bulk purchases of entries makes entering the lottery multiple times more desirable. Consequently, the size of the lottery prize fund is increased, making entering the lottery more desirable still. For example, in one embodiment, for every three entries purchased, a player receives an additional bonus entry; this encourages players to purchase three entries (as opposed to two or one) as compared to not offering any bulk purchase bonus. Therefore more total entries are likely to be sold, making more money available for prizes.

Another way in which the system operator funds the lottery prizes is through the display of advertisements to players. A portion of the revenue received from advertisers is directed towards the lottery prizes. Thus, rewarding engagement with third party partners is of value because greater levels of engagement with third party content presented to players increases the perceived value of the lottery to those third party partners. Consequently, the system operator can charge more for displaying advertisements and other third party content. As an incentive to players to interact with third party content, the content is displayed in conjunction with a reward that is available for interacting with the content, such as "one free entry for clicking this ad" or "three free entries for completing this survey."

More detailed interactions with third party partners by a player can also be rewarded. More detailed interactions are generally of greater value to third party partners, and hence, the system operator. For example, the system operator may have an arrangement with an on-line store that the system operator will receive a commission (e.g., 10%) on any sales resulting from a player clicking on an advertisement for the on-line store. Consequently, the player is further incentivized to engage in these kinds of detailed interactions, for example by offering double the reward that was on offer for simply clicking an advertisement if a purchase is also made. Other third party partner interactions can also be incentivized, such as performing searches using a search box embedded in the lottery application 340, and engaging with embedded content from third party web sites (e.g., liking a "FACEBOOK™ page of the day that is presented to the player within the lottery application).

Incentivizing tribe activity is also of value. By encouraging players to involve their friends, the participant base for the lottery is expanded—the lottery can "go viral." The most valuable tribe activity a player can perform is to refer a new eligible player to participate. Thus, a substantial reward (e.g., 100 entries) can be awarded by the user behavior module 450 to a user for each additional eligible player who is referred by the user. A limit of new players registered and/or checks such as IP matching can be implemented to ensure players do not cheat the system by registering multiple times under assumed identities to claim the resulting new player rewards. Encouraging activity among existing tribe members is also desirable as it increases total lottery participation. Thus, a player can receive additional rewards based on the total rewards earned by the player's tribe. For example, a player might receive a bonus entry in the lottery for every ten entries earned by the player's tribe. In this way, players are incentivized to encourage activities among their tribe. Players may also be rewarded for sending messages to tribe members from within the lottery application 340, up to a daily limit (e.g., 10) to encourage communication and active involvement.

In one embodiment used with a PLS type lottery players are rewarded for: 1) providing additional profile information, 2) dollar amount of deposits, 3) total number of deposits 4) regularity of deposits (once a week, once a month, etc.), 5) duration of play (how long a player leaves money in the PLS system), 6) engagement with third party partners, and 7) tribe activities. Players are generally awarded points, which can be exchanged for lottery entries, rather than directly awarded free entries, but the same principles apply as if entries are directly awarded. Players in a tribe also have additional ways of earning rewards, as described below, some or all of which can also result in reward points being assigned to the player that recruited them and/or other tribe members.

Providing points rewards based on the dollar amount of a deposit has much the same rationale as incentivizing bulk purchases of entries in an online lottery, and works in much the same way. The number of points awarded can be proportional to the dollar amount of a player's deposits, with increasing number of points for larger deposits. Thus, a player is rewarded for making a large single deposit (or possibly based on a total amount of deposits in a fixed time period, such as one day) to encourage the player to save, rather than spend, by depositing money in the PLS. For example, a player may receive a base value of one point per dollar deposited, and receive ten bonus points for each $100 deposited.

Rewarding players based on the total number of deposits made encourages good financial habits, particularly with low income players for whom small regular deposits represent the only way of building a savings account. The total number of deposits made by a player is evaluated periodically (e.g., once a month, once a week, etc.) and points awarded based on how many deposits were made during that period.

Rewarding players based on the regularity of deposits made also encourages good financial habits, particularly with low income players for whom small regular deposits represent the only way of building a savings account. Thus, players can be awarded points for making a predetermined number of regular (e.g., weekly, monthly) deposits. For example, a player may be awarded five points after making consistently making a weekly deposit for five consecutive weeks.

It is generally desirable for players to leave money in their account for as long as possible once it has been deposited. As well as representing good financial behavior by the players (they are not spending their savings) it also ensures that the system operator's bank account is well funded, helping increase the size of the prize fund. This is discussed in greater detail below with reference to the prize fund module 460. For these reasons, players are incentivized with the offer of reward points to keep money they have deposited in the PLS system. A record of when a player has made deposits and the value of those deposits is stored in the user financial data 496. Each unit of value (e.g., ten dollars) that a user has deposited is rewarded with a set number of points (e.g., one point) for each time period (e.g., week) that it remains deposited in the PLS system. In some cases, the points awarded for a given unit of value per time period may increase the longer the unit of value remains in the system. The number of points awarded for a given unit of value may be capped or otherwise limited in order to prevent the number of points awarded becoming too large. If a player withdraws some fraction of their deposited money, a first in, first out rule can be used to deincentivize such withdrawals. That is to say, the unit of value generating the most points for the player will be withdrawn before a unit of value the player has only recently deposited.

In one embodiment, the pay-in module 430 caps the total number of entries that a player may purchase or obtain through deposit in a given time period (e.g., one week) at a threshold value, while allowing the player to obtain additional entries by recruiting additional players join the online lottery or PLS system and become part of the recruiting player's tribe. The threshold can be based on economic metrics for the country that the player's resides in, for example as a percentage (e.g., 5%) of the median monthly income level for that country. This prevents players from spending too much of their income on the lottery or PLS system to increase their chances of winning, and instead encourages them to recruit additional players. This is beneficial to the lottery operator as it also increases the total number of players and leads to further revenue.

In other embodiments, different combinations and/or additional player behaviors are incentivized with the offer of bonus lottery entries and/or PLS points. For example a PLS lottery aimed at low-income players can incentivize regular deposits, but not total dollar amount of deposits to prevent wealthy investors from being able to dominate the PLS system. As another example, a system operator could offer free entries in the lottery to players who advertise the lottery on a personal blog or social network profile.

The prize fund module 460 manages income generated by the lottery and determines the total value of the prize fund for each draw, accounting for overhead expenses and the like, and is one means for performing this function. Each draw period, the prize fund module 460 determines the income coming into the lottery, including income generated by player deposits and third party partner revenue. In an online lottery, all of the money paid-in by players for entries contributes to the total income. In contrast, for a lottery that is part of a PLS system, players retain the right to withdraw their deposited money, and consequently the deposits themselves are not considered income. However, in one embodiment, the prize fund module 460 invests player deposits in a U.S. savings account or other financial instruments such as treasuries, CDAR, index funds, bonds, and the like, and the deposits therefore earn interest. Some or all of the interest earned on player deposits is treated as income and therefore contributes to the prize fund.

In one embodiment, the prize fund module 460 records each instance of income generation (e.g., entry purchases, advertisement revenue, interest payments, etc.) in the financial data 492. In each lottery cycle (the time period between draws) the prize fund module 460 determines the total income generated in the current lottery cycle using the financial data 492. The prize fund module 460 then divides the total income into a prize fund portion and an expenses portion (e.g., 90% for the prize fund and 10% for expenses). The prize fund portion is used for paying prizes to lottery winners during the next draw and determines the total size of prizes (e.g., jackpot value). If there is no jackpot winner in a given lottery cycle, the remaining prize fund may roll-over to the next draw, in which case, the prize fund module 460 includes the roll-over value when determining the total income for the next lottery cycle. The expenses portion is set aside and used by the system operator to pay operational expenses and costs. The prize fund module 460 may provide estimates of the prize fund at certain times (e.g., daily) during a lottery cycle by considering the income up to that time and making a projection regarding the likely income for the whole cycle based on historical trends (e.g., what days of the week players generally purchase the most entries). These estimates can be used in lottery promotion. For example, if there have been a number of roll-overs in a row, an estimated large jackpot can be advertized to encourage more players to participate. In another embodiment, the prize amount of each lottery is predetermined.

The lottery module 470 conducts periodic draws to select winning entries that entitle the corresponding player to a prize, and is one means of performing this function. If the lottery is part of a PLS in which players earn points, players can exchange those points for entries in the lottery. In one embodiment the lottery module 470 automatically converts points players have amassed before a lottery draw. In another embodiment, players can amass points for as long as they wish, with a player's points only being converted into entries at the request of the player. A PLS system may provide other ways in which a player can use points, such as donating points to charity, sending points as gifts to friends, using points to purchase merchandise from the system operator, and the like.

In one embodiment, the system operator determines how many winners will be selected each draw, and a corresponding number of winning entries are randomly selected from among all of the entries, where each entry is associated with a player. The winning entries may all be entitled to an equal share of the prize fund, or other breakdowns may be used. For example, one grand prize winner could receive 50% of the prize fund, with two runners up receiving 20% each and ten minor prize winners receiving 1% each.

In another embodiment of an online lottery, a player's entry comprises a selection of a set of lottery numbers in a predetermined range (e.g., six numbers, each between 1 and 50), which may be selected by the player or randomly generated. The lottery module 470 randomly selects a winning set of numbers, and then identifies which entries have numbers matching the winning set of numbers. An entry may be required to match every number in the winning set, or a partial match may also result in a prize being awarded. For example, if entries contain six numbers between one and fifty, and six numbers are drawn, each match of four numbers may be entitled to an equal share of 1% of the prize fund, each match of five numbers may be entitled to an equal share of 9% of the prize fund, and each match of all six numbers may be entitled to an equal share of 90% of the prize fund. Thus, some, all, or none or the prize fund may be claimed in any given drawing, with any proportion of the prize fund not awarded rolling over to the next draw.

The pay-out module 480 manages the transfer of money from the system operator to a player's account, and is one means for performing this function. The pay-out module 480 receives an indication of a winning entry from the lottery module 470 and identifies the corresponding user profile in the user profile data 494. The pay-out module 480 sends a notification that a prize has been won to the player associated with a winning entry using contact information from the user profile (e.g., by sending an SMS text message to the winning player's cell phone, sending an email to the winning player's recorded email address, etc.) The pay-out module 480 does not immediately transfer money into the bank account of the player associated with a winning entry at this stage. Rather, the pay-out module 480 sends a request to the eligibility module 420 to execute the second eligibility check for the player associated with a winning entry, as described above. In one such embodiment, the notification that the pay-out module 480 sends to the player associated with a winning entry also includes instructions on how to initiate the second eligibility check.

Where the lottery is part of a PLS, the pay-out module 480 manages the withdrawal of player deposits, as well as the payment of prize money (which occurs in substantially the same manner as described above with reference to conventional lotteries). If a player submits a request to withdraw some or all of the money the player has deposited in the PLS system, the pay-out module 480 initiates a payment from the player's PLS account to an account specified by the player for receiving the payment, and adjusts the financial data 492 and user financial data 496 accordingly. In one such embodiment, the pay-out module 480 charges the player a fixed fee and/or percentage commission on the withdrawal to cover banking costs, such as the cost of converting the withdrawn money into the player's local currency.

FIG. 5 is a chart 500 illustrating exemplary data sources that may be used by the eligibility module 420 to determine whether a prospective player is an Excluded Person due to U.S. citizenship (501 and 503) and/or U.S. residence (501 and 502), or whether a player is eligible to participate in the lottery (504). In one embodiment, the eligibility module 420 searches eligibility data 498 to determine whether a prospective player that attempts to register for the lottery can be positively identified as an Excluded Person using data obtained as part of the registration process. If the eligibility module 420 does not determine the prospective player to be an Excluded Person during the first eligibility check, the prospective player's registration is approved. If the registered player later wins a prize, the eligibility module performs the second eligibility check in which proof that the player associated with a winning entry is not an Excluded Person may be sought. This second eligibility check can be automated, semi-automated (e.g., the eligibility module sends a request to the player associated with a winning entry to provide electronic copies of documents proving eligibility), or manually driven (e.g., the eligibility module 420 informs a human operator that the player associated with a winning entry requires vetting and will not issue the prize until the human operator provides confirmation that the player associated with a winning entry has been vetted). In one embodiment, if the eligibility module 420 determines that an individual may be an Excluded Person; the individual is flagged as a potential Excluded Person. A flagged individual is automatically notified and provided with an online form for submitting information to prove eligibility. For example, if the eligibility module 420 determines from one or more of its data sources that a prospective player is a U.S. citizen, the prospective player may prove eligibility by providing documentation proving a previous legal renouncement of U.S. citizenship. Alternatively, a flagged individual may first be identified to a human operative to determine the validity of the flag, and to take followup steps to verify the eligibility of the player.

Referring again to FIG. 5, the bottom-left quadrant 503 of the chart 500 shows some exemplary data sources that the eligibility module 420 can make use of to determine that a prospective player is a U.S. citizen. As noted above, during registration, a prospective player can be asked to provide a name and date of birth. As all individuals born within the United States are U.S. citizens (unless they later renounce their citizenship), searching such third party databases (or such a database included as part of the eligibility data 498) using the name and date of birth provided during registration can provide evidence that the prospective player is a U.S. citizen.

Many courts and other government agencies also maintain lists of individuals that have become U.S. citizens after birth via naturalization. Searching such records (or equivalents included as part of the eligibility data 498) can provide evidence that a prospective player is a U.S. citizen in cases of naturalization, where birth records are inadequate. Similarly, only U.S. citizens are eligible to receive U.S. passports. Thus, a database of passport holders (maintained either by a third party or as part of the eligibility data 498) can provide evidence that a prospective player is a U.S. citizen. In one embodiment, immigration records from non-U.S. government agencies are also used to provide evidence of U.S. citizenship. Many countries maintain immigration records that include the citizenship of the immigrants listed. If a prospective player indicates residence in a foreign country during registration, that country's immigration records can be searched to provide evidence that the prospective player is a U.S. citizen living abroad.

The top-right quadrant 502 of the chart 500 shows some exemplary data sources that the eligibility module 420 can make use of to determine that a prospective player is a U.S. resident. If a prospective player's client device 180 is GPS enabled, the lottery application can send location data for the prospective player to the eligibility module 420. Similarly, if the registration request is submitted via the Internet, the IP address of the prospective player's client device 180 can also generate location data for the prospective player. In one embodiment, if the location data for the prospective player corresponds to a location within the United States, then the prospective player can immediately be determined to be an Excluded Person, at least at the present time. It is possible that the prospective player is a foreign national who is only visiting the United States. In which case, while the prospective player is an Excluded Person while physically located in the United States, the prospective player will be eligible to participate on returning home.

Other indicators that prospective players currently reside in the United States include that they provide an address within the United States during registration, that the registration request comes from or includes a phone number from the United States, that the registration request includes details of a financial account with a U.S. financial institution, and that an active social security number is either provided by the prospective player during registration or identified as corresponding to an individual who matches the registration information provided (e.g., by searching a third party database or the eligibility data 498).

The top-left quadrant 501 of the chart 500 indicates that any of the data sources that can be used to identify U.S. citizens who are not U.S. residents and vice versa can also be used to identify prospective players who are both U.S. citizens and residents, with the exception of foreign immigration records (although a prospective player who is a U.S. citizen and emigrates to a foreign country, but later returns to the United States, may still be identified as a U.S. citizen, and hence an Excluded Person, from foreign immigration records).

Data from these various sources and types can be evaluated to determine whether a player is an Excluded Person. Some types of data are generally dispositive (e.g., a U.S. place of birth, Social Security Number), while others are indicative (e.g., a U.S. phone number or bank account, GPS data within the U.S.). Accordingly, in one embodiment, the eligibility module 420 combines rules to identify an Excluded Person based on dispositive data (e.g., a U.S. birth location), along with a multi-factor approach with each indicative data given a weight, to determine total weighted score based on the indicative data. If a prospective player is determined to belong in any of the ineligible quadrants 501, 502, and 503 based on either the dispositive or weighted data, then the prospective player is flagged as an Excluded Person. In one embodiment, the information regarding a prospective player flagged as an Excluded Person is stored as part of the eligibility data 498. This assists in the detection of individuals who attempt to beat the eligibility module 420 and register for the lottery despite being an Excluded Person by providing false registration information. In one embodiment, if a prospective player is flagged as an Excluded Person, any further registration requests from the same IP address as the user's client device will automatically be flagged as an Excluded Person and forwarded to a human operator for review. If the IP address is determined to correspond to a large institution (e.g., a college campus) or the computer is public access (e.g., at a library) then the human operator may override the flag, assuming that there are not other reasons to believe that the prospective player is an Excluded Person. One of skill in the art will recognize that data obtained regarding prospective players who are flagged as Excluded Persons may be utilized in many ways to aid in the future identification of repeat attempts to register by the same individual.

The bottom-right quadrant 504 of the chart 500 shows some exemplary data sources that may be used as evidence that a player is not an Excluded Person, and therefore eligible to participate in the lottery and win prizes. As mentioned above, a second eligibility check is executed by the eligibility module 420 after a player is associated with a winning entry in a lottery. In one embodiment, the second eligibility check preferably includes additional steps beyond those used in the first eligibility check, and uses further evidence submitted to the lottery system 110. Additional evidence can be in the form of photographs of documents that are uploaded to the lottery system, and reviewed by an operator. Examples of documents that can be submitted include a foreign passport, foreign birth certificate, foreign bank account statements, and so forth.

In one embodiment, eligibility module 420 provides an automated workflow that directs the operator through a series of steps to review and validate the submitted documentation. For example, if a user profile indicates an address in a foreign country, a foreign phone number, and/or a foreign bank account, this is strong evidence that the corresponding player is not a U.S. resident. The automated workflow provided by the eligibility module includes having the operator review each of the submitted document, and perform additional validation searches of commercial and other database as needed, for example, searching databases in regards to the user's name, address, place of birth, telephone number, citizenship records. Additional workflow steps can include automatically calling the user's mobile telephone number for the operator and connecting the operator to the call to speak to the player (assuming the phone number is genuine) to verify the phone number. The system operator may also verify that the player has access to the bank account by making a series of small deposits and requiring the player provide details of the amounts deposited. Other methods may be used to verify address, phone number, and bank details in order to verify that a player selected for a prize is not a U.S. resident.

Exemplary Method

Figure 6:
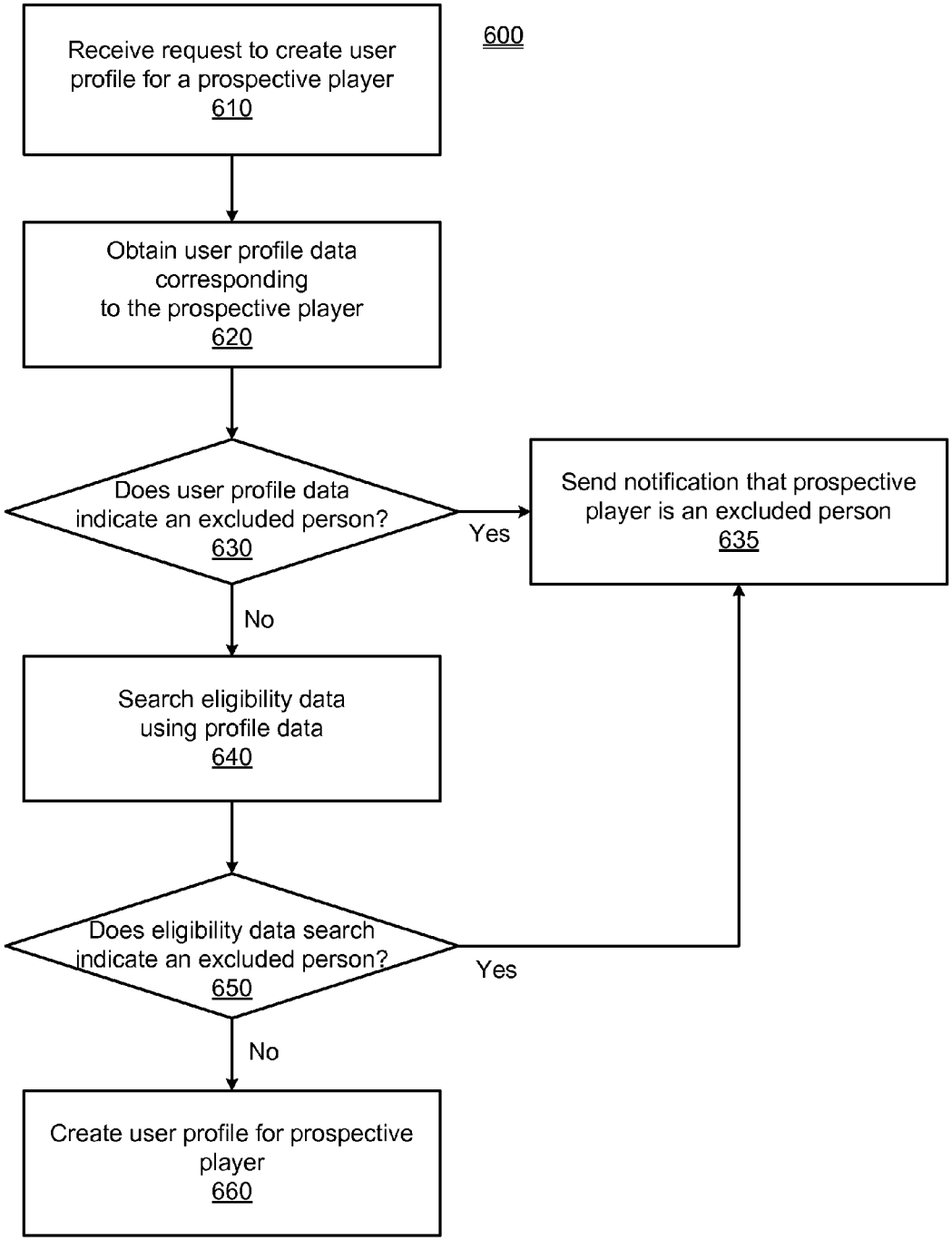
FIG. 6 is a flow chart illustrating a method for creating a user profile that includes checking whether a prospective player is excluded from participating in a lottery.

FIG. 6 is a flow chart illustrating a method 600 for a prospective player to create a user profile that includes checking whether the prospective player can be verified as an Excluded Person, and therefore prohibited from participating in a lottery. In FIG. 6 the steps of the method 600 are performed by the lottery computer system 110. However, some or all of the steps may be performed by other computer systems operating in conjunction with the lottery computer system 110. In addition, some embodiments may perform the steps in parallel, perform the steps in different orders, and/or perform different steps.

Initially, at 610, the user profile module 110 receives a request to create a user profile for a prospective player. Depending on the embodiment, the request can be generated by the prospective player: interacting with the lottery computer system 110 from a client device 180 such as a smartphone, sending an SMS text message to a number provided by a local phone company, or in other ways.

At 620, the user profile module 410 obtains profile data for the prospective player. If the prospective player is creating the user profile by interacting with the lottery computer system 110 in real time, the user profile module 410 requests the profile data by providing a web-form or other user interface to the prospective player's client device 180, via the network 170. The prospective player completes the web-form and the information entered is sent back to the user profile module 410, via the network 170. If the prospective player is not interacting with the lottery computer system 110 in real time (e.g., if the profile request was submitted via SMS text message) then the required profile data is requested by contacting the prospective player (e.g., by sending an SMS text message). As well as the profile data explicitly provided by the prospective player, the profile data may also include automatically gathered profile data, such as the prospective player's IP address, or the phone number from which an SMS text message profile request was sent.

At 630, the eligibility module 420 determines whether the user profile data received indicates that the prospective player is an Excluded Person without the need for further research. If anything in the received user profile data indicates that the prospective player is a U.S. citizen and/or resident, the method 600 proceeds to 635 and sends a notification that the prospective player is an Excluded Person. For example, if the prospective player did not read the terms and conditions, an address within the United States may be provided, immediately indicating that the prospective player is a U.S. resident and therefore an Excluded Person. As another example, the prospective player may have completed the web-form from a home computer in the United States, in which case the IP location data will indicate that the prospective player is within the United States. As described previously, in one embodiment, the prospective player is invited to provide additional information to prove that they are not an Excluded Person at this time (not shown).

At 640, the eligibility module 420 uses the received user profile data to search the eligibility data 498 to generate a sub-set of eligibility data that may correspond to the prospective player. As described previously, the eligibility data 498 can be data stored locally at the lottery computer system 110 and/or third party databases accessed remotely.

At 650, the eligibility module 420 determines whether anything in the sub-set of eligibility data 498 indicates that the prospective player is an Excluded Person. If the eligibility module 420 determines that the subset of eligibility data 498 indicates that the prospective player is a U.S. citizen and/or resident, the method 600 proceeds to 635 and sends a notification that the prospective player is an Excluded Person. As described previously, in one embodiment, the prospective player is provided with an opportunity to prove eligibility to participate in the lottery at this stage (not shown). If the eligibility module 420 does not identify any evidence that the prospective player is an Excluded Person, it is assumed that the prospective player is eligible to participate in the lottery and a user profile is created 660 and stored in the user profile data 494.

Figure 7:
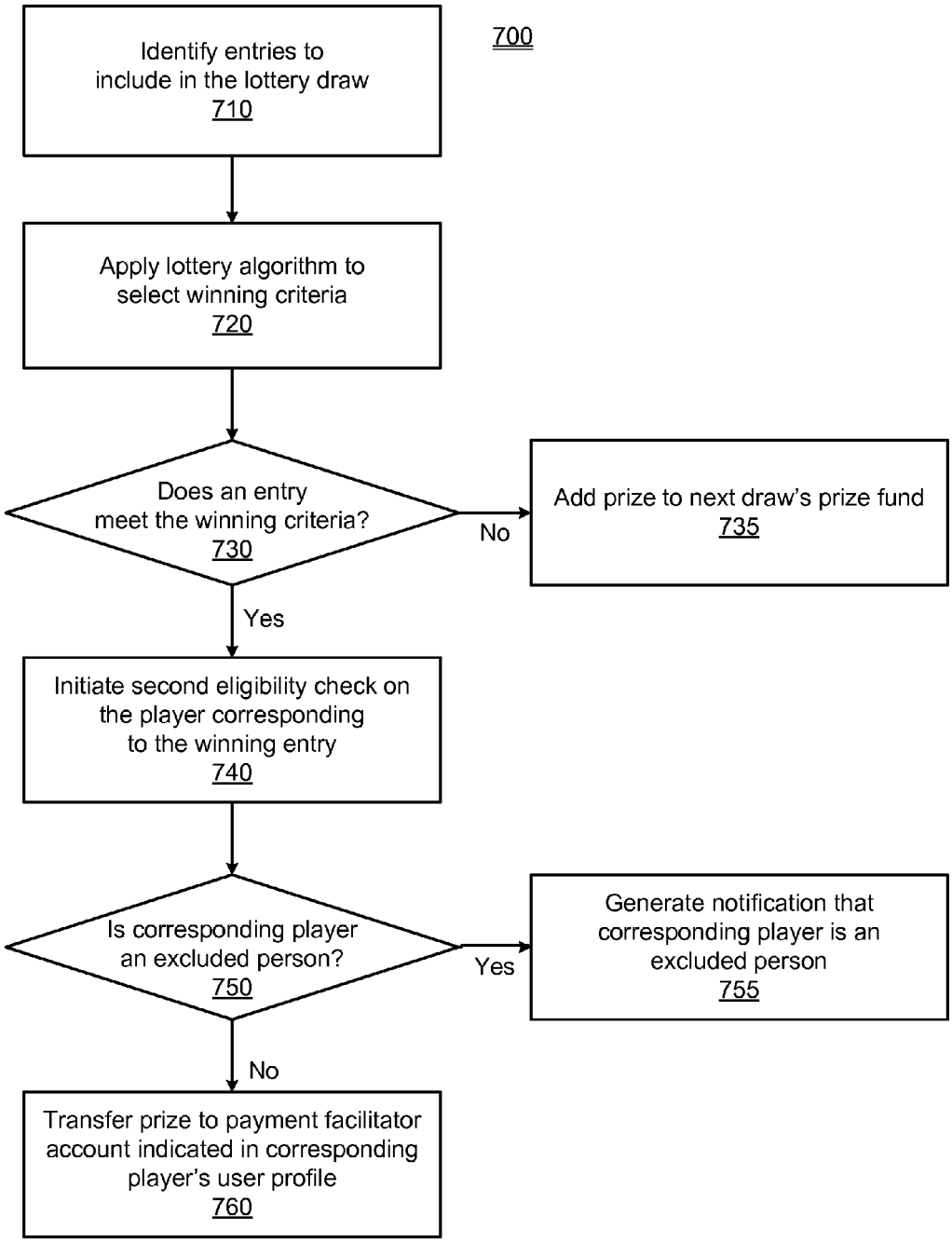
FIG. 7 is a flow chart illustrating a method for conducting a lottery draw and verifying that a winning entry does not correspond to an Excluded Person.

FIG. 7 is a flow chart illustrating a method 700 for conducting a lottery draw and verifying a player associated with a winning entry is not an Excluded Person. In FIG. 7 the steps of the method 700 are performed by the lottery computer system 110. However, some or all of the steps may be performed by other computer systems operating in conjunction with the lottery computer system 110. In addition, some embodiments may perform the steps in parallel, perform the steps in different orders, and/or perform different steps.

Initially, at 710, the lottery module 470 identifies lottery entries to include in the lottery draw. In one embodiment, the lottery is an online lottery and players specify which draw they wish to enter when purchasing entries. Alternatively, entries may automatically be entered in the next draw that is scheduled to occur. The number of entries and an indication of the corresponding draw are stored as part of the user profile data 494. When conducting a lottery draw, the lottery module 470 examines the user profile data 494 and identifies all entries that correspond to the lottery draw being conducted.

In the PLS type system, lottery entries are obtained in exchange for points. Players may "purchase" entries into a draw with points they have earned in much the same manner as described above. Alternatively, the lottery module 470 may examine the user profile data 494 while conducting a lottery draw and automatically convert all points earned by players into entries (except any excess balance of points that is not sufficient to exchange for an entry).

At 720, the lottery module 470 applies a lottery algorithm to select winning criteria that identify what constitutes a winning entry. In one embodiment, the lottery module 470 simply randomly selects a winning entry associated with one of the players. For example, a hash table can be stored in memory, with each player having a number of entries in the hash table equal to the number of entries they have purchased, either by cash or by points. To select a winning entry, a random number is generated, and hashed into the table, thereby selecting one of the entries. The player associated with the selected entry is identified as the possible winner of the lottery, subject to the second eligibility check.

In another embodiment, the winning criteria include six randomly generated numbers between one and fifty. When purchasing lottery entries in such a lottery, players select six numbers between one and fifty (or have six numbers randomly assigned). Any lottery entry for which the selected numbers correspond to the randomly generated numbers is a winning entry. Thus, any number of entries (including zero) may be winning entries in any given draw. As described previously, a full match may award a large prize, with partial matches awarding smaller prizes.

At 730, the lottery module 470 selects an entry (or multiple entries) that meet the winning criteria, and are therefore winning entries. If no entries meet the winning criteria, the method 700 proceeds to 735 and the prize money is added to the prize fund for the next draw. Thus, if there are no winning entries for a number of draws, the prize fund can grow to a substantial size, making participation in the lottery more desirable, which in turn grows the prize fund even further.

Assuming that at least one entry does meet the winning criteria, the lottery module 470 identifies the player (or players) associated with the selected entry (or entries) to the eligibility module 420. At 740, the eligibility module 420 initiates the second eligibility check for each player associated with a winning entry. If the eligibility module determines 750 by the second eligibility check that a player is an Excluded Person (i.e., ineligible to participate in the lottery), the method proceeds to 755 and the eligibility module 420 generates a notification that the player is an Excluded Person. In one embodiment, the player is notified that attempting to participate in the lottery as an Excluded Person is a violation of the TOS and the player's user profile is suspended, preventing further participation. As noted above, the TOS includes a Retroactive Exclusion provision to which the player has agreed. U.S. Federal and state law enforcement may also be notified, for example if laws require that illegal gambling activity be reported.

If the second eligibility check successfully verifies that the player associated with a winning entry is not an Excluded Person, and thus a winning player, the method 700 proceeds to 760 and the pay-out module 480 transfers the prize to a financial account listed in the winning player's user profile. If the user profile of the winning player is not already linked to a financial account, the pay-out module 480 generates a notification that one must be created. In one embodiment, the pay-out module 480 notifies the winning player using contact information in the user profile data 494 (e.g., by sending an SMS text message, email, etc.) that informs the winning player of the requirement to provide the details of a financial account to which prize money will be transferred. In another embodiment, the pay-out module 480 generates a notification for a human operator who contacts the winning player to assist them in opening a financial account. This is particularly advantageous for operating a lottery in areas of low economic prosperity, where many prospective players may not have a bank account or the knowledge and means to open one. For example, the system operator may send a representative to meet the winning player and assist in opening a bank account, as well as providing a fraction of the prize money in local currency to use as an initial deposit. As well as assisting the winning player, this can also be leveraged by the system operator to generate exposure and media attention for marketing purposes.

Figure 8:
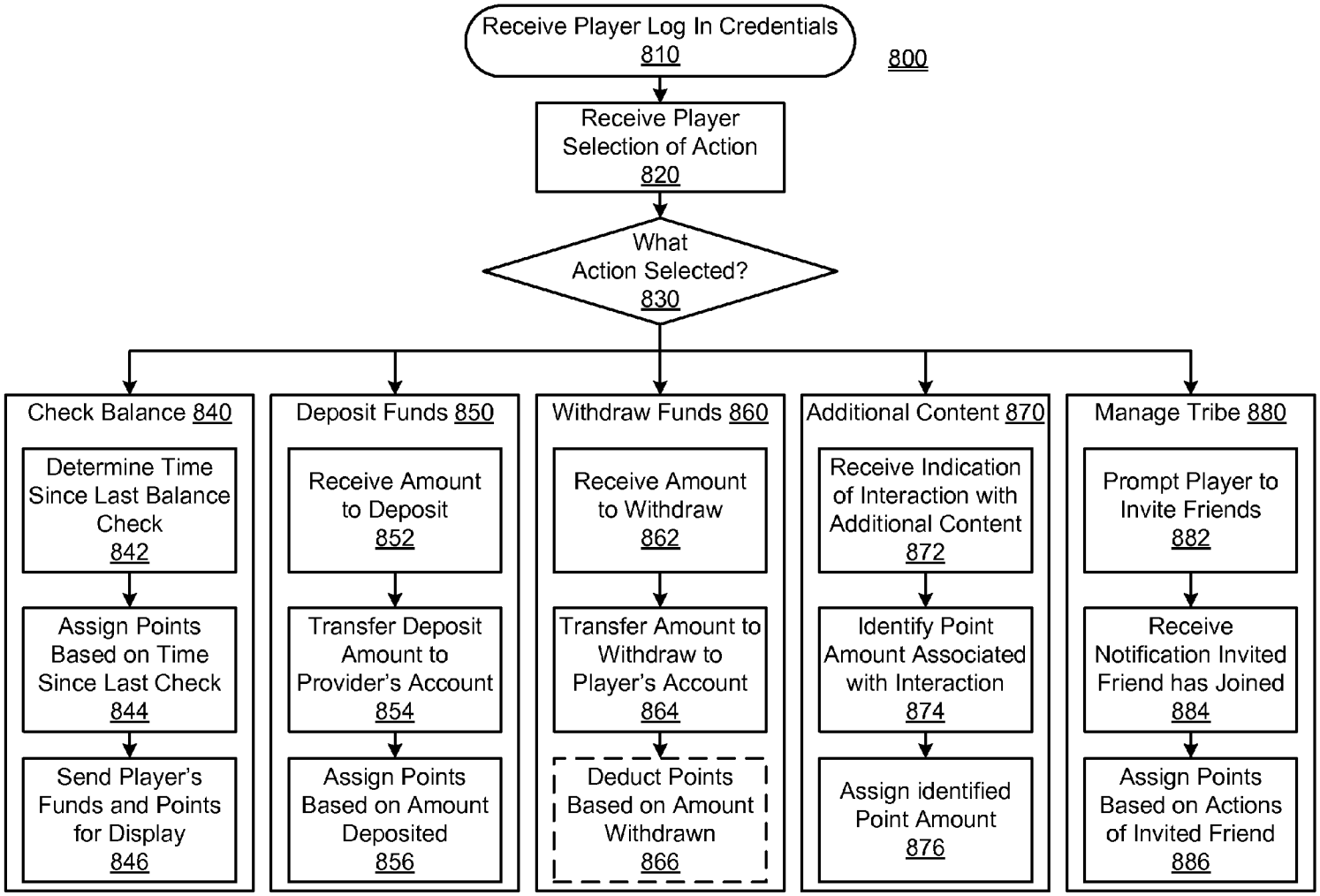
FIG. 8 is a flow chart illustrating a method for a lottery computer system to process exemplary player actions that affect a player's points total in a PLS system.

FIG. 8 is a flow chart illustrating a method 800 for a lottery computer system 110 to process exemplary player actions that affect a player's points total in a PLS system. In FIG. 8 the steps of the method 800 are performed by the lottery computer system 110. However, some or all of the steps may be performed by other computer systems operating in conjunction with the lottery computer system 110. In addition, some embodiments may perform the steps in parallel, perform the steps in different orders, and/or perform different steps. In the following description, reference is made to the lottery application 340 as the mechanism by which the player interacts with the lottery computer system 110, but it is appreciated that players may instead use the browser module and the lottery website 115 directly. Further, some of the actions may be initiated via a financial institution. For example, if a user deposits funds in a PLS linked account, either using the financial institution's website or in-person, the PLS provider may be automatically notified of the transaction, and points applied to the user's PLS account.

Initially, at 810, the user profile module 410 receives a player's log in credentials (e.g., username and password) from the lottery application 340 on the player's client device 180. The lottery application 340 presents a user interface at the client device 180 that includes controls for a user to initiate a plurality of actions within the PLS system. In the embodiment shown, the actions include checking the balance of the player's PLS account 840, depositing funds in the player's PLS account 850, withdrawing funds from the player's PLS account 860, interacting with additional content provided by the PLS 870 (e.g., advertisements, on-line courses, etc.), and managing the player's tribe 880.

At 820, the user behavior module 450 receives a selection of one of the actions from the client device 180, via the network 170. At 830, the user behavior module 450 identifies which action was selected and the method 800 proceeds along the corresponding branch.

In one embodiment, if the player selects check balance 840, the user behavior module 450 determines the amount of time since the player last requested a balance check 842. In one embodiment, this is done by recording the date and time of each balance check as part of the user profile data 492. The user behavior module 450 then assigns the player a number of points based on the amount of time that has passed since the player last requested a last balance check. In one embodiment, the number of points assigned is inversely proportional to the amount of time, and thus encourages players to make regular balance checks, up to some predetermined limit. In other embodiments, other methods for determining the number of points assigned are used. Once the player's points total has been adjusted, the user behavior module 450 sends an indication of the amount of money the player currently has deposited in the PLS and the player's points total to the client device 180 for display 846.

If the player selects deposit funds 850, the lottery application 340 prompts the player to provide an amount to deposit. Alternatively a fixed amount for a deposit may be set by the player and/or the PLS provider (e.g., $10). The lottery application 340 sends an indication of the amount to be deposited to the pay-in module 430, via the network 170. On receiving the amount to be deposited 852, the pay-in module 430 initiates a transfer of funds from a financial account of the player to a financial account of the PLS provider 854. On successful completion of the transfer, the user behavior module 450 assigns points to the player based on the amount deposited 856.

If the player selects withdraw funds 860, the lottery application 340 prompts the player to provide an amount to withdraw. Alternatively a fixed amount for a withdrawal may be set by the player and/or the PLS provider (e.g., $10). The lottery application 340 sends an indication of the amount to be withdrawn to the pay-out module 480, via the network 170. On receiving the amount to be withdrawn 862, the pay-out module 480 initiates a transfer of funds from a financial account of the PLS provider to a financial account of the player 864. On successful completion of the transfer, the user behavior module 450 deducts points from the player's points total based on the amount withdrawn 866. In one optional embodiment, the user behavior module 450 deducts a fixed number of points (e.g., one) for each dollar the player withdraws. In another embodiment, the user behavior module 480 determines the proportion of the player's total funds deposited in the PLS the withdrawal represents and deducts an equivalent proportion of the player's points. In this way, players can be prevented from remaining eligible (due to bonus points earned for desirable behaviors) to receive prizes after withdrawing all of the money they had previously deposited in the PLS. Other embodiments determine the amount of points to deduct in response to a withdrawal of funds in other manners.

If the player selects additional content 870, the user behavior module 450 receives an indication of the particular piece of additional content and the particular interaction of the player with the additional content 872. The selection of additional content is used herein to include any incentivized player interaction with additional content, providing additional profile information, clicking on (or otherwise showing interest in) advertisements, taking surveys, taking on-line classes, interacting with embedded content from third party websites, purchasing products from third party partners, and the like. The user behavior module 450 identifies the amount of reward points associated with the particular interaction 874 and assigns the points to the player's user profile 876.

If the player selects manage tribe 880, the lottery application 340 provides a user interface at the client device 180 prompting the player to invite one or more friends to join the PLS 882. In one embodiment the player identifies friends to invite by providing email addresses, providing phone numbers, or by selecting friends to invite from a list of social network contacts provided by an API of the social network. The user behavior module 450 sends an invitation including a link to access the PLS to the identified friends using the identifying information provided, for example by sending an email to the provided email addresses including a link to download the PLS application and/or a link to a sign-up page of the PLS website. In one embodiment, the link includes data identifying the player that issued the invitations (e.g., a player ID). In another embodiment, the invitation includes an identification code (e.g., the inviting player's player ID) that the invited player provides manually when signing-up.

If an invited friend joins the PLS and identifies the inviting player, either automatically (e.g., by clicking on a link in an invitation) or manually (e.g., by providing the player ID of the inviting player), the user profile module 410 sends a notification to the player behavior module 450 that the invited friend has joined the PLS 884. The user behavior module 450 then assigns points to the inviting player based on the actions of the invited friend 886. The actions that points can be awarded for include the act of signing up in the first place and any other actions that generate points for the invited player. In one embodiment, a player receives a fixed number of points (e.g., 100) for every invited friend that signs up for the PLS and a fixed percentage (e.g., 10%) of any points earned by invited friends.

One set of embodiments uses SMS (Short Message Service) capabilities of mobile telephones to provide the interface and communications mechanism between the user's client device 180 and the lottery system 110. The lottery system 110 can include a SMS compatible gateway for interfacing with a short message service centre (SMSC), where it is assigned one or more SMS addresses for receiving SMS messages from the user devices 180. One of the advantages of using SMS for communication is that players do not need modern/expensive client devices 180 with Internet access to participate in the lottery.

In one such embodiment, the user sends SMS text messages containing instructions (e.g., a UIN, indicating the user has purchased an entry into the lottery at a store that should be included in the next draw) to the local number provided by the system operator. The instructions are sent on to the lottery provided as described above, and the user's participation in the lottery managed accordingly.

The user initially registers with the system operator by proving a cell phone number, the user's bank account details (including authorization to charge lottery entry purchases to the player's account with a third party payment processor), and (optionally) additional details about the user (e.g., name, address, citizenship, etc.).

The user can then enter the lottery by simply sending an SMS text message to the system operator, with the cost of the lottery entry being automatically debited from the player's account. Players set up a profile corresponding to their cell phone numbers and then submit entries by sending an SMS text message to the local number that including identifying information and (optionally) a number of entries the player wishes to purchase. On receiving the source phone number and content of the SMS text message, the user profile module 410 determines if the identifying information provided in the SMS text message matches that stored in the user profile corresponding to the source phone number.

The system operator may require that the text message includes identifying information for the user, such as a password, to reduce the risk of fraudulent entries being submitted without the consent of the user, for example if the user's cell phone is stolen.

If the user wins a prize, then an SMS text message is sent to the phone number that submitted the winning entry providing instructions regarding how to claim the prize. For example, the player associated with a winning entry may have to contact a representative of the system operator and initiate the second eligibility check to ensure the player associated with a winning entry is not an Excluded Person. The player associated with a winning entry may also have to provide details of and/or open an account with a local financial institution in which to receive prize money.

In one embodiment, players purchase entry cards at local stores and report entries for inclusion in the next draw by sending SMS text messages including UINs obtained from the entry cards. Each entry card can represent one or more entries in the lottery. For example, cards representing 1, 5, and 10 entries may be available. The player sends an SMS message including the UIN from their cell phone (client device 180) to the local number. The phone number of the cell phone and the UIN are then sent to the lottery computer system 110, via the network 170.

On receiving the phone number and UIN, the user profile module 410 identifies a user profile in the user profile data 494 that corresponds to the source phone number. The pay-in module 430 then determines how many entries the UIN corresponds to and increases the number of entries in the next draw for the identified user profile accordingly as well as generating a request to obtain the system operator's portion of the price paid for the entry card from the local store. The pay-in module 430 charges the cost of the entries to the player via the third party payment facilitator 150. The pay-in module 430 also increases the number of entries in the next draw recorded in the player's user profile accordingly.

Additional Configuration Considerations

Some portions of above description describe the embodiments in terms of algorithmic processes or operations. These algorithmic descriptions and representations are commonly used by those skilled in the data processing arts to convey the substance of their work effectively to others skilled in the art. These operations, while described functionally, computationally, or logically, are understood to be implemented by computer programs comprising instructions for execution by a processor or equivalent electrical circuits, microcode, or the like. Furthermore, it has also proven convenient at times, to refer to these arrangements of functional operations as modules, without loss of generality. The described operations and their associated modules may be embodied in software, firmware, hardware, or any combinations thereof.

As used herein any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment.

Some embodiments may be described using the expression "coupled" and "connected" along with their derivatives. It should be understood that these terms are not intended as synonyms for each other. For example, some embodiments may be described using the term "connected" to indicate that two or more elements are in direct physical or electrical contact with each other. In another example, some embodiments may be described using the term "coupled" to indicate that two or more elements are in direct physical or electrical contact. The term "coupled," however, may also mean that two or more elements are not in direct contact with each other, but yet still co-operate or interact with each other. The embodiments are not limited in this context.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

In addition, use of the "a" or "an" are employed to describe elements and components of the embodiments herein. This is done merely for convenience and to give a general sense of the disclosure. This description should be read to include one or at least one and the singular also includes the plural unless it is obvious that it is meant otherwise.

Upon reading this disclosure, those of skill in the art will appreciate still additional alternative structural and functional designs for a system and a process for operating a lottery within the United States in which United States' citizens and residents are excluded from participating. Thus, while particular embodiments and applications have been illustrated and described, it is to be understood that the described subject matter is not limited to the precise construction and components disclosed herein and that various modifications, changes and variations which will be apparent to those skilled in the art may be made in the arrangement, operation and details of the method and apparatus disclosed herein.

EXAMPLE A

Example Terms of Service

You acknowledge and agree that persons who: (i) are citizens of the United States of America who reside in the United States of America or in any other country, territory, commonwealth or other geographic location or, (ii) reside in the United States of America, regardless of their country of citizenship, and regardless of any designation of the United States Immigration and Naturalization Service or any persons who reside in the United States of America as undocumented aliens or under any other circumstance; are not eligible to enter or participate in the Lottery.

Persons who are either citizens of the United States of America, regardless of their residency or residents of the United States of America, regardless of their immigration status or country of citizenship are explicitly barred from entering and playing the Lottery and are defined herein as "Excluded Persons."

You hereby represent, warrant and certify that you are NOT an Excluded Person.

You acknowledge and agree that, if you are an Excluded Person, you shall never be entered in the Lottery, and therefore you shall never be eligible to win any prizes.

You further acknowledge and agree that any attempt to circumvent the restrictions on play by any Excluded Person shall constitute a breach of this Agreement.

An attempt at circumvention of the restrictions on play by any Excluded Person shall include, but is not limited to, falsely stating your country of citizenship or country of residency, manipulating other information used by us to further ascertain your country of citizenship and country of residency, manipulating information used by the identify your location and providing the with false or misleading information regarding your location, mobile phone number or other information requested by us (hereinafter defined as "False Entry").

You acknowledge and agree that the results of the Lottery shall ONLY indicate possible eligibility for certain entries in the Lottery to win prizes and such results do not indicate that you or any other person is entitled to any prizes.

You acknowledge and agree that we can undertake any action to determine whether you are eligible for a prize at any time. You acknowledge and agree to provide your full cooperation, and that the procedures used shall be solely determined by us on a case-by-case basis in our sole discretion.

You acknowledge and agree that if; (i) you are an Excluded Person, or (ii) were an Excluded Person when you provided your information to us, or (iii) if you become an Excluded Person after providing your information to us; you are not eligible for entry in the Lottery, and were not and are not entered in the Lottery.

What is claimed is:

1. A method, implemented on a lottery computer system comprising at least one processor, of operating a lottery, from a jurisdiction, for registered players that are not residents or citizens of the jurisdiction, the method comprising performing on the lottery computer system the steps of:

receiving, by the lottery computer system, from a prospective player a request to obtain an entry to the lottery;

determining, by the lottery computer system, whether the prospective player is a citizen or a resident of the jurisdiction according to an Internet Protocol (IP) address of a computing device of the prospective player used to access the lottery computer system, wherein an IP address within the jurisdiction indicates that the prospective player is a citizen or a resident of the jurisdiction;

enabling, by the lottery computer system, the prospective player to obtain at least one entry to the lottery only if it is determined that the prospective player is not a citizen or a resident of the jurisdiction, thereby making the prospective player one of the registered players;

receiving, by the lottery computer system, a plurality of entries into the lottery, each entry corresponding to at least one registered player;

selecting, by the lottery computer system, a winning entry from among the plurality of entries, the winning entry corresponding to a registered player; and awarding, by the lottery computer system, a prize to the registered player corresponding to the winning entry.

2. The method of claim 1, wherein awarding a prize to the registered player corresponding to the winning entry further comprises:

determining whether the registered player is a citizen or a resident of the jurisdiction by comparing a proportion of IP addresses used by the computing device to access the lottery computer system that are within the jurisdiction to a threshold proportion, wherein the proportion of IP addresses within the jurisdiction being less than a threshold proportion indicate that the registered player is not a citizen or resident of the jurisdiction; and awarding, by the lottery computer system, the prize to the registered player only if it determined that the registered player is not a citizen or a resident of the jurisdiction.

3. The method of claim 1, wherein awarding a prize to the registered player corresponding to the winning entry further comprises:

receiving, from a Global Positioning System receiver in the computing device of the registered player, Global Position System (GPS) data indicating geographic locations at which the computing device of the registered player has been present within a predetermined time period prior to the winning entry being selected;

determining a proportion of the geographic locations that are within the jurisdiction; and awarding, by the lottery computer system, the prize to the registered player only if the determined proportion is less than a threshold proportion.

4. The method of claim 1, wherein awarding a prize to the registered player corresponding to the winning entry further comprises:

determining by the lottery computer system a plurality of first geographic locations of a computing device of the registered player used to access the lottery computer system according to one or more of the IP addresses used by the computing device within a predetermined time period prior to the winning entry being selected;

receiving, from a Global Positioning System receiver in the computing device of the registered player, Global Position System (GPS) data indicating a plurality of second geographic locations at which the computing device of the registered player has been present within the predetermined time period prior to the winning entry being selected;

determining a total proportion of the first and second geographic locations that are within the jurisdiction; and awarding, by the lottery computer system, the prize to the registered player only if the determined total proportion is less than a threshold proportion.

5. The method of claim 1, wherein creating, by the lottery computer system, the user profile comprises:

providing, by the lottery computer system, a terms of service for display to the prospective player, the terms of service including notification that citizens or residents of the jurisdiction are not eligible for participation in the lottery, and that registered players determined to be citizens or residents of the jurisdiction shall be retroactively excluded from participation in the lottery; and registering, by the lottery computer system, the prospective player as a registered player responsive to receiving an indication of acceptance of the terms of service.

6. A computer system comprising:

an electronic data store configured to store user profiles of users;

an eligibility module executable by the computer system to automatically determine from an Internet Protocol (IP) address of a computing device of the user used to access the computer system and a telephone number assigned to the computing device, whether the user is a citizen or a resident of the jurisdiction based on whether the IP address and telephone number correspond to geographic locations within the jurisdiction, and only in response to automatically determining that the user is not a resident or citizen of the jurisdiction, enable the user to register with the computer system as a player in a lottery executed by a lottery module of the computer system, purchase lottery tickets from a pay-in module of the computer system, and collect a prize from a pay-out module of the computer system;

the pay-in module executable by the computer system to identify a number of entries into the lottery for each player, the number of entries for a player based on lottery ticket purchases or financial behavior of the player;

the lottery module executable by the computer system to select a winning entry; and the pay-out module executable by the computer system to award a prize to the player corresponding to the winning entry only if the eligibility module determines that the player corresponding to the winning entry is not a resident or citizen of the jurisdiction.

7. The computer system of claim 6, wherein the eligibility module is further executable to automatically determine whether a user is a citizen or a resident of the jurisdiction as part of a user profile creation process.

8. The computer system of claim 6, wherein the eligibility module is further executable to automatically determine whether the winning player is a citizen or a resident of the jurisdiction after the selection of the winning entry by the lottery module by determining whether one or more IP addresses used by the computing device of the winning player within a predetermined time period prior to the winning entry are within the jurisdiction.

9. The computer system of claim 6, wherein the eligibility module is further configured to determine whether the prospective player is a citizen or a resident of the jurisdiction by:

determining that the prospective player is a resident of the jurisdiction responsive to the user profile data including a phone number issued in the jurisdiction.

10. A method implemented on computer system, the method comprising:

receiving by the computer system a plurality of entries into the lottery, each entry associated with a corresponding user, the lottery operated by the computer system within a jurisdiction;

selecting by the computer system a winning entry from among the plurality of entries, the winning entry associated with a winning user;

automatically determining by the computer system a plurality Internet Protocol (IP) addresses of the computing device of the winning user used to access the computer system within a specified time period prior to the selection of the winning user; and awarding by the computer system a prize to the user only if less than a threshold proportion of the automatically determined IP addresses of the computing device of the winning user are within the jurisdiction.

11. A method implemented on a gaming computer system, comprising:

receiving at the gaming computer system from a computing device of a prospective player a request to participate as a registered player in a gaming event operated by the gaming computer system, the gaming event occurring within a first country, the request including a telephone number of the user;

determining from the telephone number a country code for the telephone number;

determining a second country associated with the country code;

determining an Internet Protocol (IP) address of the computing device from which the request of the prospective user was received;

determining a geographic location for the IP address;

determining whether or not the first country is the second country;

determining whether or not the geographic location is within the first country;

determining that the prospective user is authorized to participate in the gaming event only in response to the determining that the first country is not the second country and the determining that the geographic location is not within the first country; and creating an entry in a gaming event database indicating the prospective user as a registered player in the gaming event.

12. The method of claim 11, further comprising:

providing to the registered player a number of entries into the gaming event based at least in part on a number of entries in the gaming event by a first group of users invited to participate in the gaming event by the registered player who then become registered players, and based on a number of a second group of users who become registered players in the gaming event after being invited to participate in the gaming event by one or more registered players from the first group.

13. The method of claim 11, wherein creating an entry in a gaming event database indicating the prospective user as a registered player in the gaming event further comprises:

providing, by the gaming computer system, a terms of service for display on the computing device of the prospective user, the terms of service including notification that citizens or residents of the first country are not eligible for participation in the gaming event, and that registered players subsequently determined to be citizens or residents of the first country shall be retroactively excluded from participation in the gaming event; and registering, by the gaming computer system, the prospective user as a registered player responsive to receiving an indication from the computing device of the prospective user of acceptance of the terms of service.

14. The method of claim 11, further comprising:

receiving from a computing device of a registered player of the gaming computer system a request for an additional entry in a gaming event operated by the gaming computer system, the event occurring within a first country, the request including a telephone number of the user;

determining that the registered player is eligible for additional entries in the gaming event only in response to the gaming computer system determining that the registered player has not exceeded the respective maximum allowable entries in the gaming event for a given time period; and creating the additional entries in a gaming event database for the registered player.

15. A method implemented on a gaming computer system operating a gaming event, comprising:

selecting by the gaming computer system from a plurality of registered players in the gaming event operated by the gaming computer system, a registered player to receive a winning outcome of the gaming event, wherein the gaming event occurs within a jurisdiction, and wherein the registered player accesses the gaming computer system from a computing device;

determining a plurality of Internet Protocol (IP) addresses of the computing device used by the registered player to access the gaming computer system within a specified time period prior to the selection of the registered player;

determining a proportion of the IP addresses of the computing device used by the registered player that are within the jurisdiction;

responsive to the proportion of IP addresses of the computing device used by the registered player that are within the jurisdiction being less than a threshold proportion, determining that the registered player is not a citizen or a resident of the jurisdiction, and updating an entry in a gaming event database indicating the registered player is confirmed to receive the award associated with the winning outcome; and responsive to the proportion of IP addresses of the computing device used by the registered player that are within the jurisdiction being greater than a threshold proportion, determining that the registered player is a citizen or a resident of the jurisdiction and, updating an entry in the gaming event database indicating the registered player is not confirmed to receive the award associated with the winning outcome.

16. A method implemented on a gaming computer system, comprising:

receiving from a computing device of a prospective user of the gaming computer system a request to participate as a registered player in a gaming event operated by the gaming computer system, the gaming event occurring within a jurisdiction;

receiving from a Global Positioning System (GPS) receiver in the computing device GPS data indicating a current geographic location of the computing device of the prospective user; and responsive to determining that the current geographic location of the computing device of the prospective user is not within the jurisdiction, determining that the prospective user is not a citizen or a resident of the jurisdiction, and creating an entry in a gaming event database indicating the prospective user is a registered player in the gaming event.

17. A method implemented on a gaming computer system operating a gaming event, comprising:

selecting by the gaming computer system, from a plurality of registered players in the gaming event a registered player to receive a winning outcome of the gaming event, wherein the gaming event occurs within a jurisdiction, and wherein the registered player accesses the gaming computer system from a computing device;

receiving from a Global Positioning System (GPS) receiver in the computing device of the registered player GPS data corresponding to a plurality of geographic locations at which the computing device of the selected registered player was present in the jurisdiction within a specified time period prior to the selection of the registered player;

determining from the GPS data a proportion of the geographic locations at which the computing device of the selected registered player was present that are within the jurisdiction;

responsive to the proportion of geographical locations at which the computing device of the selected registered player was present that are within the jurisdiction being less than a threshold proportion, determining that the selected registered player is not a citizen or a resident of the jurisdiction, and updating an entry in a gaming event database indicating the selected registered player is confirmed to receive an award associated with the winning outcome; and responsive to the proportion of geographic locations at which the computing device of the selected registered player was present that are within the jurisdiction being greater than a threshold proportion, determining that the selected registered player is a citizen or a resident of the jurisdiction, and updating an entry in the gaming event database indicating the selected registered player is not confirmed to receive the award associated with the winning outcome.

18. A method implemented on a lottery computer system of operating a lottery in a jurisdiction for registered players that are not residents or citizens of the jurisdiction, the method comprising:

receiving, by the lottery computer system from a computing device of a prospective player, a request to obtain at least one entry to the lottery, the lottery operated by the computer system, the lottery occurring in the jurisdiction;

automatically determining by the lottery computer system an Internet Protocol (IP) address of a computing device of the prospective player used to access the lottery computer system;

responsive to automatically determining, by the lottery computer system, that the prospective player is not a citizen or a resident of the jurisdiction based at least in part upon the automatically determined IP address not being within the jurisdiction, providing by the lottery computer system at least one entry to the lottery for the prospective player, making the prospective player one of the registered players.

19. The method of claim 18, further comprising:

responsive to automatically determining that the prospective player is a citizen or a resident of the jurisdiction based at least in part upon the automatically determined IP address being within the jurisdiction, providing by the lottery computer system a message to the computing device of the prospective player that the player is not eligible to obtain an entry to the lottery.

20. A method implemented on a lottery computer system of operating a lottery, the method comprising:

receiving, by the lottery computer system from a computing device of a prospective player, a request to obtain at least one entry to the lottery, the lottery operated by the computer system, the lottery occurring in the jurisdiction;

automatically determining by the lottery computer system whether the prospective player is a citizen or a resident of the jurisdiction based upon whether an Internet Protocol (IP) address of a computing device of the prospective player used to access the lottery computer system is within the jurisdiction;

providing, by the lottery computer system, at least one entry to the lottery to the prospective player only if it is automatically determined that the prospective player is not a citizen or a resident of the jurisdiction, thereby making the prospective player one of the registered players;

receiving, by the lottery computer system, a plurality of entries into the lottery, each entry corresponding to a registered player;

selecting, by the lottery computer system, a winning entry from among the plurality of entries, the winning entry corresponding to a registered player; and awarding, by the lottery computer system, a prize to the registered player corresponding to the winning entry.

21. The method of claim 20, wherein awarding, by the lottery computer system, a prize to the registered player corresponding to the winning entry, further comprises:

automatically determining by the lottery computer system one or more the IP addresses used by the computing device after the at least one entry to the lottery was provided to the registered player;

determining a proportion of the IP addresses that are within the jurisdiction; and awarding, by the lottery computer system, the prize to the registered player only if the determined proportion is less than a threshold proportion.

22. The method of claim 20, wherein awarding, by the lottery computer system, a prize to the registered player corresponding to the winning entry, further comprises:

automatically determining by the lottery computer system IP addresses used by the computing device after the at least one entry to the lottery was provided to the registered player;

automatically determining, by the lottery computer system, that the registered player is not a citizen or a resident of the jurisdiction based at least in part upon a plurality of the determined IP addresses of the computing device not being within the jurisdiction; and awarding, by the lottery computer system, the prize to the registered player only if it is automatically determined that the registered player is not a citizen or a resident of the jurisdiction.

23. A method implemented on a lottery computer system of operating a lottery within a jurisdiction, the method comprising:

selecting, by the lottery computer system, a winning entry from among the plurality of entries, the winning entry corresponding to a registered player, wherein the lottery is operated by the computer system, the lottery occurring in the jurisdiction;

automatically determining, by the lottery computer system after the winning entry is selected, at least one Internet Protocol (IP) Address used by a computing device of registered player used to access the lottery computer system;

responsive to automatically determining, by the lottery computer system, that the at least one IP address is not within the jurisdiction, determining that the prospective user is not a citizen or a resident of the jurisdiction and awarding by the lottery computer system the prize to the registered player corresponding to the winning entry; and responsive to automatically determining, by the lottery computer system, that the at least one IP address is within the jurisdiction, determining that the prospective user is a citizen or a resident of the jurisdiction and not awarding, by the lottery computer system, the prize to the registered player corresponding to the winning entry.

* * * * *